US006935081B2

(12) United States Patent
Dunn et al.

(10) Patent No.: US 6,935,081 B2
(45) **Date of Patent: *Aug. 30, 2005**

(54) REINFORCED COMPOSITE SYSTEM FOR CONSTRUCTING INSULATED CONCRETE STRUCTURES

(76) Inventors: Daniel D. Dunn, P.O. Box 308, Honeyville, UT (US) 84314; David C. Dunn, P.O. Box 308, Honeyville, UT (US) 84314

( * ) Notice: Subject to any disclaimer, the term of this patent is extended or adjusted under 35 U.S.C. 154(b) by 61 days.

This patent is subject to a terminal disclaimer.

(21) Appl. No.: 10/660,944

(22) Filed: Sep. 12, 2003

(65) Prior Publication Data

US 2004/0045238 A1 Mar. 11, 2004

Related U.S. Application Data

(63) Continuation-in-part of application No. 09/803,205, filed on Mar. 9, 2001, now Pat. No. 6,647,686.

(51) Int. Cl.[7] ..... E04B 2/28

(52) U.S. Cl. ..... 52/426; 52/309.11; 52/309.12; 52/309.17; 52/442; 52/562; 249/38; 249/41; 249/191; 249/214; 249/216

(58) Field of Search ..... 52/426, 309.11, 52/309.12, 309.17, 442, 562, 71, 220.2, 309.14, 425, 713, 591.2, 592.6, 105; 249/33, 38, 40, 41, 189, 190, 210, 214, 216

(56) References Cited

U.S. PATENT DOCUMENTS 4,223,501 A 9/1980 DeLoizier
4,229,920 A 10/1980 Lount
4,439,967 A 4/1984 Deilenberg
4,604,843 A 8/1986 Ott et al.
4,698,947 A 10/1987 McKay (Continued)

*Primary Examiner*—Brian E. Glessner
*Assistant Examiner*—Yvonne M. Horton

(57) ABSTRACT

A reinforced composite system for constructing insulated concrete structures comprising, panels having a foam plastic core between outside and inside reinforcement layers, reinforcement layers substantially strengthen the panels during material handling and construction, greatly reducing deflection of the panels between studs when placing concrete allowing walls to be filled in one lift. Panels are placed horizontally in an opposing and parallel spaced-apart relation. Opposing panels are placed end to end in rows and stacked vertically, rows of panels being staggered from each other so panel ends in adjacent rows do not line up vertically. Vertical studs are embedded in panels extending the full height of the panels, each stud having a flange for receiving mechanical fasteners and groove for receiving spreaders. A plurality of spreaders at each stud location extend between opposing panels and slidably engaging the studs in opposing panels. Spreaders are stacked vertically in such a manner as to engage studs half their height above and below the horizontal joints between rows of panels. Each spreader has opposing flanges connected by horizontal members, horizontal members having multiple formations, when spreaders are stacked the formations compliment each other allowing wall reinforcement bars to be restrained in any preferred location. Hollow horizontal stiffeners may be utilized to accommodate electrical wiring. Locations of vertical studs are shown by markings on the exterior of panels. Hinged corner forms and bearing ledge forms can be shipped flat and rotated into position on site.

9 Claims, 18 Drawing Sheets

U.S. PATENT DOCUMENTS 4,706,429 A 11/1987 Young
4,730,422 A 3/1988 Young
4,731,968 A 3/1988 Obino
4,866,891 A 9/1989 Young
4,884,382 A 12/1989 Horobin
5,014,480 A 5/1991 Guarriello et al.
5,102,710 A 4/1992 Kaufman et al.
5,107,648 A 4/1992 Roby
5,123,222 A 6/1992 Guarriello et al.
5,140,794 A 8/1992 Miller
5,390,459 A 2/1995 Mensen
5,459,971 A * 10/1995 Sparkman ..... 52/426
5,465,542 A 11/1995 Terry
5,487,284 A 1/1996 Artzer
5,568,710 A 10/1996 Smith et al.
5,570,550 A 11/1996 Roby
5,570,552 A 11/1996 Nehring
5,596,855 A 1/1997 Batch
5,611,182 A 3/1997 Spude
5,625,989 A 5/1997 Brubaker et al.
5,649,401 A 7/1997 Harrington, Jr.
5,657,600 A 8/1997 Mensen
5,658,483 A 8/1997 Boeshart
5,664,382 A 9/1997 Melnick et al.
5,701,710 A 12/1997 Tremelling
5,704,180 A 1/1998 Boeck
5,709,060 A 1/1998 Vaughan et al.
5,735,093 A 4/1998 Grutsch
5,771,648 A 6/1998 Miller et al.
5,809,727 A 9/1998 Mensen
5,809,728 A 9/1998 Tremelling
5,845,449 A 12/1998 Vaughan et al.
5,852,907 A 12/1998 Tobin et al.
5,887,401 A 3/1999 Moore, Jr.
5,890,337 A 4/1999 Boeshart
5,896,714 A * 4/1999 Cymbala et al. ..... 52/426
5,924,247 A 7/1999 Van Horn et al.
5,930,958 A 8/1999 Stanley
5,987,830 A 11/1999 Worley
5,992,114 A 11/1999 Zelinsky et al.
6,070,380 A 6/2000 Meilleur
6,128,882 A 10/2000 Jones
6,134,861 A 10/2000 Spude
6,170,220 B1 * 1/2001 Moore, Jr. ..... 52/741.13
6,230,462 B1 5/2001 Beliveau
6,305,142 B1 10/2001 Brisson et al.
6,318,040 B1 11/2001 Moore, Jr.
6,336,301 B1 1/2002 Moore, Jr.
6,378,260 B1 4/2002 Williamson et al.
6,401,419 B1 6/2002 Beliveau
6,418,646 B1 7/2002 Record
6,438,918 B2 8/2002 Moore, Jr. et al.
6,536,172 B1 3/2003 Amend
6,647,686 B2 * 11/2003 Dunn et al. ..... 52/426
6,668,503 B2 * 12/2003 Beliveau ..... 52/426

* cited by examiner

REINFORCED COMPOSITE SYSTEM FOR CONSTRUCTING INSULATED CONCRETE STRUCTURES

CROSS REFERENCES TO RELATED APPLICATION

This is a continuation in part of Ser. No. 09/803,205, filed Mar. 09, 2001 U.S. Pat. Pat. No. 6,647,686 and titled "System for Constructing Insulated Concrete Structures."

BACKGROUND OF THE INVENTION

The present invention relates to construction using Insulating Concrete forming Systems (ICFS), and more particularly to a new reinforced composite system for constructing insulated concrete structures.

Insulating Concrete Forming Systems (ICFS), which are currently known, act as forms for the construction of concrete walls, the end benefit is a wall which is already insulated and ready for the application of exterior and interior finish materials. The known ICFS currently in use comprise a pair of foam plastic panels connected by a plurality of ties or connectors. The panels are molded from expanded polystyrene (EPS) beads providing low density foam plastic panels which are used as a form to contain the concrete during placement. The EPS beads are expanded with high pressure steam, in molds that are confined by a large press.

An example of Known art U.S. Pat. No. 5,896,714 issued to Cymbala et al. on Apr. 27, 1999 comprises pairs of panels molded from EPS and connected by ties. The ties have opposed vertical flanges with web portions extending between. In one embodiment the flanges of the ties are molded within the panels, the web members extending between panels. In another embodiment the panels are formed with "T"-shaped slots amenable to accept the flanges of the ties.

Another example of known art is U.S. Pat. No. 6,170,220 issued to Moore, Jr. on Jan. 9, 2001 comprising opposing panels molded from EPS and using molded-in web members. The web members have attachment points that extend past the inside face of the panels, the connecters extend between and engage the attachment points of opposing panels.

Known art systems are limited in many respects due to the materials used, the manufacturing process and the configuration of the ties, webs and connectors. The EPS foam doesn't adhere to the ties and webs when using molded-in configurations causing a weak point in the panels at each tie or web location. In the slide-in configurations the molded slots penetrate deeply into the panels also creating a weakness at each penetration. There are no ties or webs located at the panel ends allowing the vertical joints to bulge or blowout during concrete placement. The panels are manufactured in small units approximately 12 inches to 16 inches in height and 36 inches to 48 inches in length, the size being limited by the strength of the low density EPS and the prohibitive cost of larger molds and more expensive machinery to contain the molds during the high pressure steam expansion process. EPS has a relatively low R-value per inch and the poor structural characteristic make it prone to damage during material handling and construction.

The tie configuration disclosed in Cymbala is typical of many of the known art systems, the webs of the ties comprising closely spaced members leaving little open space through the webs, in effect perforating the concrete at each tie location. In Moore, Jr. there are numerous connectors required between the panels to hold the pressure of the poured concrete. These restrictive configurations, and the close spacing of the ties, webs and connectors, create a structural weakness in the wall caused by the number of penetrations through the concrete, in addition they inhibit the natural flow of the concrete during placement increasing the difficulty of pouring the walls and causing honey comb in the concrete. The inherent weakness of the EPS makes it very difficult to vibrate the walls to increase the concrete flow and reduce the honey comb without causing the forms to bulge or blowout. In the molded-in tie and web configurations the inability of the EPS to bond to the flanges of the ties and web members allows the panels to split along the flanges under the pressure of the concrete during placement, causing the walls to bulge and blowout. In Moore, Jr. the large number of connectors that must be installed is time-consuming and the labor required is costly.

The use of EPS foam as a form material, the use of small unit sizes and the restrictive tie, web and connector configurations create difficulties that must be overcome. When using small unit sizes there are more units to set increasing the labor required to erect a wall. There are more horizontal and vertical joints increasing the possibility of blowouts during concrete placement and a greater amount of bracing is required to straighten and stabilize the walls. Great care must be taken while placing the concrete to prevent blowouts, the concrete must be placed slowly and in short lifts. Also when EPS foam is exposed to sunlight for any period of time it deteriorates causing a powder to form on the surface of the panels, thus when using finish materials which require a strong bond to the substrate special treatment is required to remove the deterioration. Because EPS does not readily accept most finish materials an additional substrate must be installed when using finish materials that bond directly to the wall, resulting in increased costs. A large amount of labor is required to prepare the numerous horizontal and vertical joints before the application of finish materials. Another downfall of the known art systems is the lack of an easy method for securing wall reinforcing, manual tying of the wall reinforcing is time-consuming and the extra labor required is costly.

BRIEF SUMMARY OF THE INVENTION

The primary object of this invention is to provide a system for constructing Insulated concrete structures that is user friendly, is durable enough to withstand handling during shipping and erection without being severely damaged and will withstand the extreme forces applied by fluid concrete when casting a wall without bulging or failing.

Another object of this invention is to provide an improved form many times larger than other systems requiring less time to erect a structure and reducing the number of horizontal and vertical joints in a wall, reducing the amount of bracing required to stabilize the walls and requiring less preparation for interior and exterior finish materials.

Another object of this invention is to provide a means of reinforcing the foam plastic panels to resist deflection and physical damage, allows the direct application of exterior and interior finish materials thereby reducing the cost of finishing walls and also protecting the foam plastic from UV degradation during storage, shipping and installation.

Yet another object of this invention is to provide an embedded stud that extends the full height of the forms strengthening the forms, provides an additional means of fastening interior and exterior finish materials and accepts slide-in spreaders to interconnect the form panels, variable spacing of studs allows additional strength to be added for greater lift heights during concrete placement and casting of thick walls.

Still yet another object of this invention is to provide a slidable spreader for connecting form panels which provides ease of installation and allows more compact shipping of forms, varying spreader sizes allowing a large variety of poured wall thicknesses.

A further object of this invention is to provide a means for spreaders to lap the horizontal joints between vertically stacked rows of forms forcing the wall to act as one unit from bottom to top, creating greater strength and stability during construction and concrete placement.

A further object of this invention is to provide a means for slide-in spreaders with multiple formations that compliment each other securing wall reinforcement bars in place there by reducing the amount of manual labor required to fasten and maintaining alignment of reinforcement bars during concrete placement.

A further object of this invention is to provide a slide-in spreader with multiple formations that allows wall reinforcement bars to be placed in any location required by professional engineers.

A further object of the invention is to provide a slide-in spreader with minimal obstructions in the wall cavity, allowing for the natural flow of concrete in the cavity during concrete placement, something unavailable in other systems.

Yet a further object of this invention is to provide for a slide-in spreader and embedded stud enabling the forms to be cut and utilized at any desired height.

Yet a further object of this invention is to provide for slide-in spreader and embedded stud installation at any vertical joint enabling the forms to be cut to any length, eliminating the need for additional bracing to prevent blow outs during concrete placement.

Another object of this invention is to provide a means of reinforcing the panels at their vertical midpoint utilizing horizontal stiffeners, the stiffeners having a hollow cross-section enabling them to accommodate electrical wiring.

Still yet another object of this invention is to provide forms having vertical or horizontal hinges which can be shipped flat and then rotated into position on site. Vertical hinged forms allowing the formation of unlimited angles and tee walls. Horizontal hinged forms can be utilized as bearing ledges for brick, rock and many other applications.

Other objects and advantages of the present invention will become apparent from the following descriptions, taken in connection with the accompanying drawings, wherein, by way of illustration and example, an embodiment of the present invention is disclosed.

The inherent problems of the prior art are overcome by the present invention, which provides a system for constructing insulated concrete structures comprising large form panels molded from a closed cell foam plastic. Each panel has a foam core between outside and inside reinforcement layers, the reinforcement layers extend substantially over, and are adhered to, the entire outside and inside surfaces of the foam plastic core. Embedded vertical studs extend the full height of the panel and a horizontal stiffener extends the full length of each panel at the vertical midpoint. The horizontal stiffeners having a hollow cross-section which may be utilized to accommodate electrical wiring. Each panel has an interlocking means comprising a tongue at the top edge of each panel and a groove at the bottom edge of each panel. The reinforcement layers on each panel extending around each tongue and into each groove, reinforcing and defining the surfaces of the tongue and groove. The groove of each panel has appendages protruding into the groove, the spacing of the appendages corresponding with the locations of the embedded studs, the tongue of each panel having slots that compliment said appendages, such that when said panels are stacked the appendages in the grooves engage the slots in the tongues forcing studs from adjacent panels into a vertical alignment. The closed cell foam plastic is easily molded and has great strength and adhesive capabilities, allowing the panels to be cast in virtually any size and permanently adheres to the studs and reinforcement layers creating an integral unit. The reinforcement layers add substantial strength to the panels, provides a UV resistant surface on the panels and are marked for visually locating the embedded studs and horizontal stiffeners. The reinforcement layers also provide a substrate for finish materials which substantially reduces the cost of finishing the wall, something which is unavailable in other systems. The studs embedded in the panels and bonded to the foam plastic add great strength to the forms, accommodate slide-in spreaders to interconnect the form panels and provide a continuous means for attaching finish materials. The panels are placed in an opposing relationship and connected by a plurality of spreaders at each stud location that slide into the studs and extend between the opposing panels, thereby creating a form with a cavity between the inside surfaces of the panels. The spreaders comprise opposing flanges oriented in a spaced apart parallel relationship, being connected by horizontal members, each horizontal member having multiple formations to accommodate wall reinforcement bars. The open design of the spreaders allows the concrete to flow naturally through the wall making concrete placement easier and resulting in a much stronger wall than the prior art. There are different widths of spreaders allowing the casting of a variety of different wall thicknesses.

Multiple form panels are placed end to end in horizontal rows and stacked vertically, panels are staggered from each other so that ends of opposing panels are offset and end joints between adjacent rows of stacked panels do not line up vertically. There are pluralities of spreaders at each stud location, the spreaders being "full height spreaders," half the vertical height of panels, and "half height spreaders," half the height of the full height spreaders. Spreaders are stacked vertically starting with a half height spreader with full height spreaders thereafter, so that at the top of each row of panels there is a full height spreader that slides into the studs in the row below half its height and into the studs in the row above the remaining half of its height, thereby stiffening the horizontal joint between rows of forms and forcing the walls to act as one unit from bottom to top. When the spreaders are stacked, the formations in the top and bottom horizontal members compliment the formations in adjacent spreaders allowing horizontal wall reinforcement bars to be locked in any preferred location, eliminating most manual tying of the reinforcement.

In another embodiment of the invention a hinged form is provided, comprising at least one vertical or horizontal pivotal point in at least one of the opposing form panels. Hinged panels can be shipped flat and then rotated into position on site. Forms with vertical pivotal points in both of the opposing panels can be used to form corners of any angle, allow tee walls to be formed easily and can also be used to form curved walls. Forms with a horizontal pivotal point in one of the opposing panels can be used to form bearing ledges to support brick or rock and are useful for many other applications. The bearing ledge forms utilize a specialized bearing ledge connector which allows the bearing ledge to be installed at any location in a wall.

The large unlimited form sizes, the reinforced foam plastic, the stud and spreader interface and the ability to lap the spreaders over the horizontal joints between rows of panels provides many benefits. The large forms require less time to place than prior art systems and the number of vertical and horizontal joints are reduced. The forms may be shipped as more compact units and assembled on site reducing the cost of shipping. The reinforcement layers strengthen the foam plastic core, protect the forms from being damaged during shipment and construction and protect them from UV deterioration. The reinforcement layers also allow finish materials to be applied directly to the forms, greatly reducing the cost of finishing the walls. Lapping the spreaders over the horizontal joints straightens, strengthens and stabilizes the walls during construction and concrete placement by forcing the walls to act as one unit from bottom to top, requiring very little bracing during construction and concrete placement.

It can be seen that the present invention provides many useful benefits that the known art systems cannot.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE INVENTION

Figure 1A:
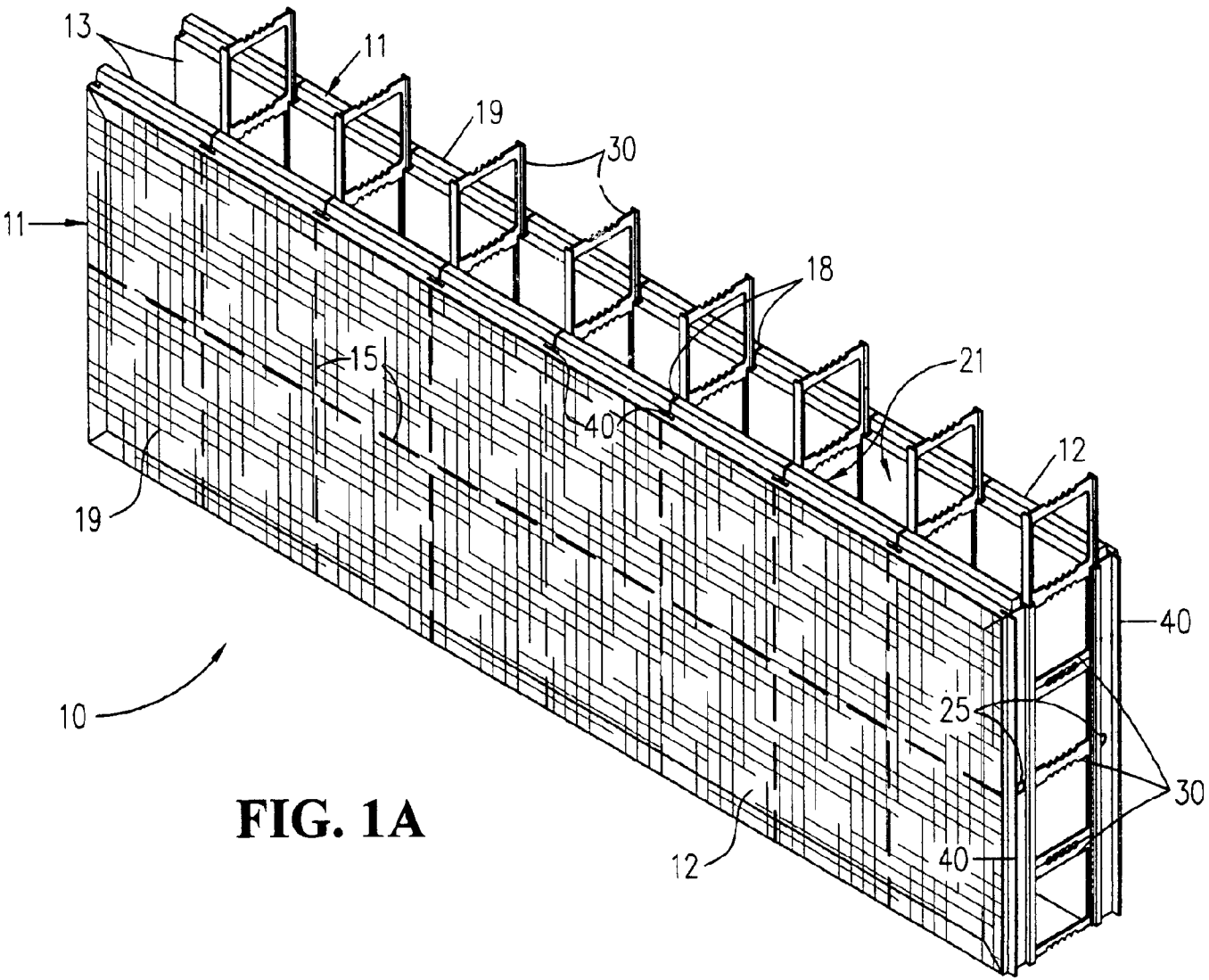
FIG. 1A is a perspective view of a reinforced composite form according to the present invention.
Figure 1B:
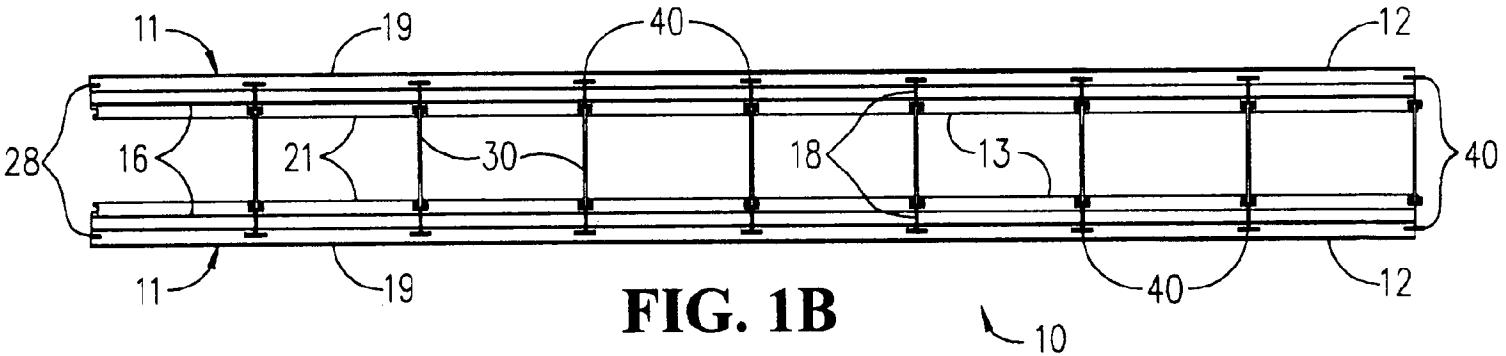
FIG. 1B is a top view of the form of FIG. 1A.
Figure 1C:
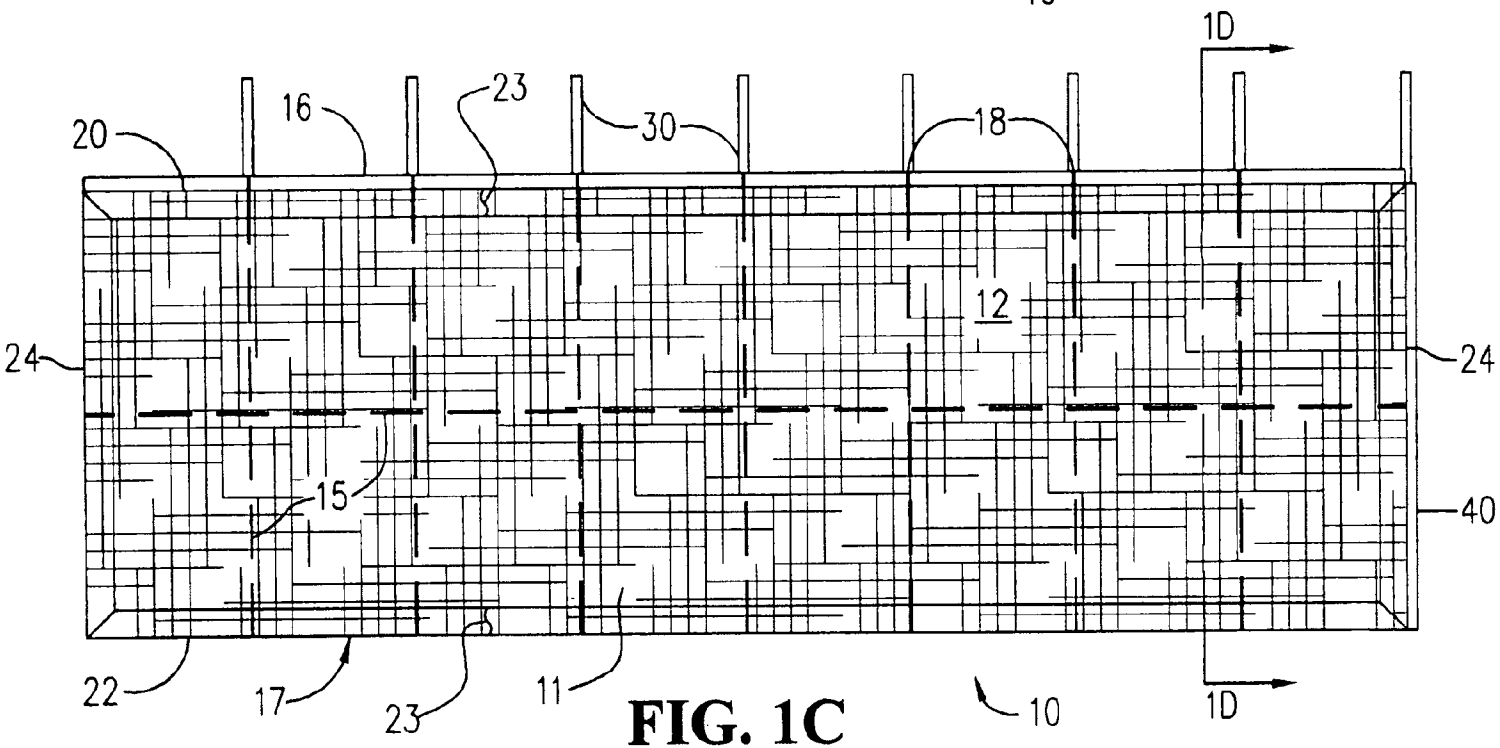
FIG. 1C is a side view of the form of FIG. 1A.
Figure 1D:
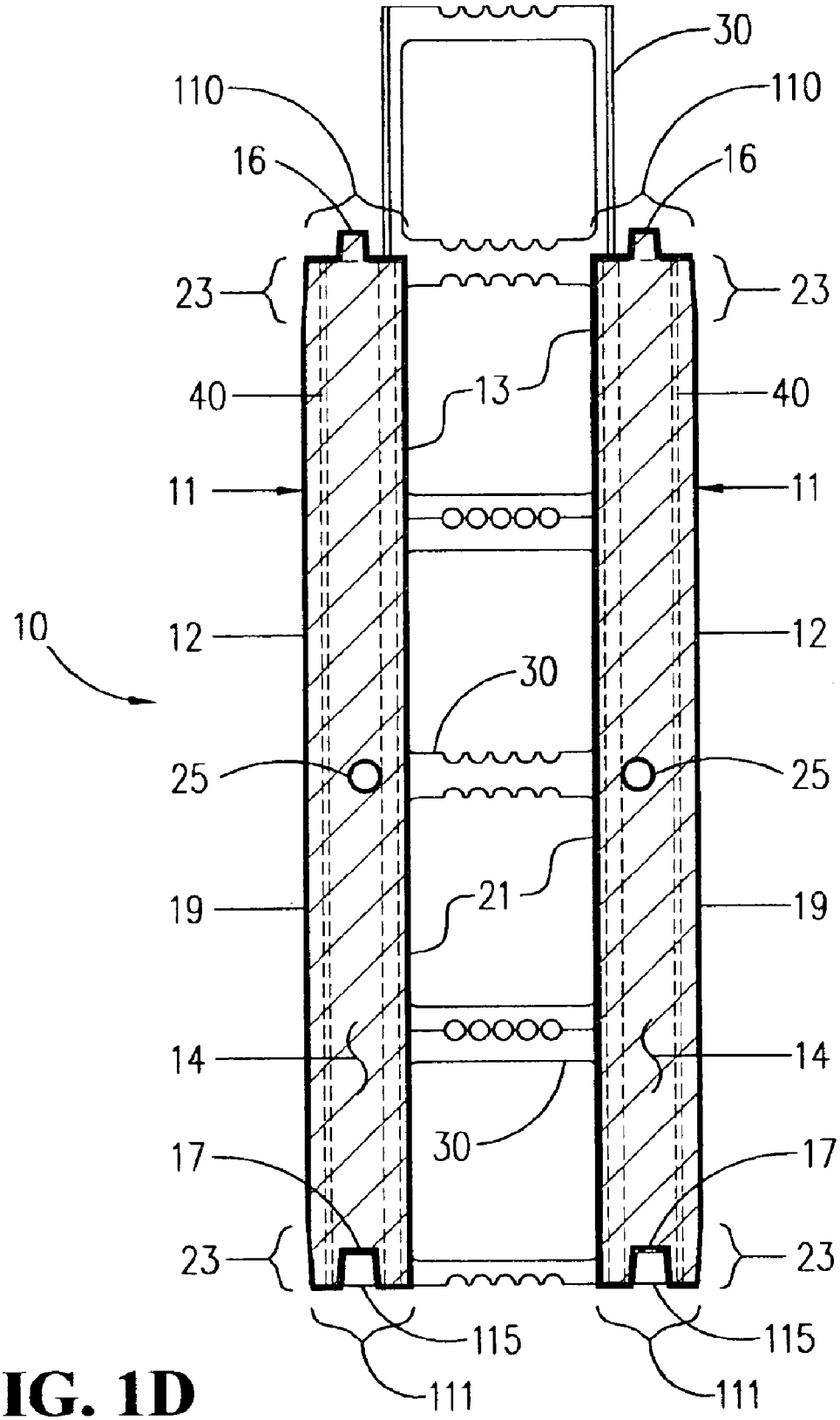
FIG. 1D is a cross-section view of the form of FIG. 1A, taken along line 1D—1D as shown in FIG. 1C.

Detailed descriptions of the invention are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Turning now to the drawings, there is shown in FIGS. 1A–9*a* reinforced composite forming system for constructing insulated concrete structures. A first embodiment of the present invention a form unit 10, as shown in FIGS. 1*a*–1*d* comprises panels 11 having outside surfaces 12 and inside surfaces 13, top 20, bottom 22 and end edges 24. Studs 40 and a horizontal stiffener 25 are embedded in each panel. The panels 11 are placed in an opposing and parallel relationship. Spreaders 30 are located at each stud 40, extending between and engaging the studs 40 in opposing panels 11 thereby creating a form 10 with a cavity between the panels 11. The cavity is filled with fluid concrete to create a structure. The structural design of the concrete structures is based on the Uniform Building Code and other accepted building codes.

The panels 11 comprise a closed cell foam plastic core 14 between an outside reinforcement layer 19 and an inside reinforcement layer 21. The reinforcement layers extend substantially over, and are adhered to, the entire outside and inside surfaces of the foam plastic core 14 thus defining the outside surface 12 and inside surface 13 of each panel. The outside reinforcement layer 19, the foam core 14 and the inside reinforcement layer 21 are continuously bonded together over their entire area thus acting together as a composite structure.

A means of interlocking the panels is provided comprising a tongue 16 that extends from and is parallel to the top edge 20 of each panel 11, and a complementary groove 17 recessed into and parallel to the bottom edge 22 of each panel 11. The inside reinforcement layer 21 of each panel extends around the tongue 16 and into the groove 17, defining and reinforcing them. The embedded studs 40 extend through the groove 17 in each panel 11 and the tongue 16 has slots 18 that correspond with the studs 40 so that when the forms 10 are stacked the studs 40 engage the slots 18 in the tongue 16 of the row of forms below, aligning studs 40 of adjacent panels 11 vertically. In a second embodiment a preformed unit is used to form the tongue 16 and groove 17. The preformed tongue 110 and groove 111 units are preferably made of plastic with appendages 115 protruding into the groove unit 111 and corresponding with the spacing of the studs 40. The appendages 115 in the groove unit 111 of each panel engage the slots 18 in the tongue 16 of the row of forms below, aligning studs 40 of adjacent panels 11 vertically. The interface of the panel 11 ends 24 comprises a stud 40 halfway into and protruding halfway from the end 24 of a first panel 11, and a complimentary slot 28 in the end 24 of a second panel 11. Additionally, the panels 11 may be cut anywhere along their length and slotted 28 to accept a stud 40. When the panels are placed end 24 to end 24, they interlock and spreaders 30 are installed to connect the opposing panels 11. Thus the present invention discloses a method of utilizing studs 40 and spreaders 30 at the vertical joints between panels 11 to prevent bulging and blow outs, something the prior art does not.

The closed cell foam plastic is preferably a plural component polyurethane consisting of an isocyanate A component and a polyol B component, which when combined react to create an expansive foam which is dispensed into molds to form the panels 11. The polyurethane foam preferably has a tensile strength of 30–45 P.S.I. and is classified by the Uniform Building Code as Class 1 fire-rated per ASTM-E-84-77*a*. The polyurethane foam has other advantageous properties such as a high insulation value per inch, great structural strength, low water absorption, a high impedance to sound transmission and excellent adhesive capabilities. The panels 11 can be molded in virtually unlimited sizes. Typical sizes will be 8 feet to 16 feet long and 2 feet 8 inches to 4 feet high, with panel 11 thicknesses from 2 inches to 6 inches depending on structural and insulation requirements. Preferred sizes for residential, commercial and industrial construction are 8 feet and 16 feet long with a height of 2 feet 8 inches and 16 feet long with a height of 4 feet.

The reinforcement layers 19 and 21 are preferably a fire resistant, flexible, fibrous material between 0.025 inches and 0.0625 inches thick and having a minimum tensile strength of 1200 P.S.I. The fibrous quality of the reinforcement layers strengthen the bond with the foam plastic, the tensile strength determines the overall deflection of the composite panels. Typically a fiberglass material approved for use as a substrate for stucco and elastomeric coatings will be used for the outside reinforcement layer 19, thus in addition to reinforcing the foam plastic core 14 the reinforcement layer can provide a prepared substrate for finish materials saving time and material costs. The inside reinforcement layer 21 preferably has a smooth outer surface allowing the concrete to flow easily inside the forms 10. Both the outside and inside reinforcement layers are UV resistant and protect the foam plastic core from degrading in sunlight. The outside reinforcement layer 19 is also marked for visually locating the embedded studs.

In a preferred embodiment the boundary of the outside surface 12 of each panel 11 is tapered 23 around the full perimeter of each panel. The taper 23 starts at each panel edge approximately ⅛ inch below the panel surface 12 and extends 2 inches toward the center of the panel 11 at which point the taper 23 is flush with the panel face 12. When installing stucco and elastomeric coatings over known art systems the joints must be pre-treated to prevent the finish from cracking over the joints between form panels, this pre-treatment usually causes a bulge in the finish coat at each joint location. The taper around the edges of the panels of the present invention allows the pre-treatnent to be installed flush with the surface of the panels eliminating unsightly bulging in the finish over the joints.

Figure 4A:
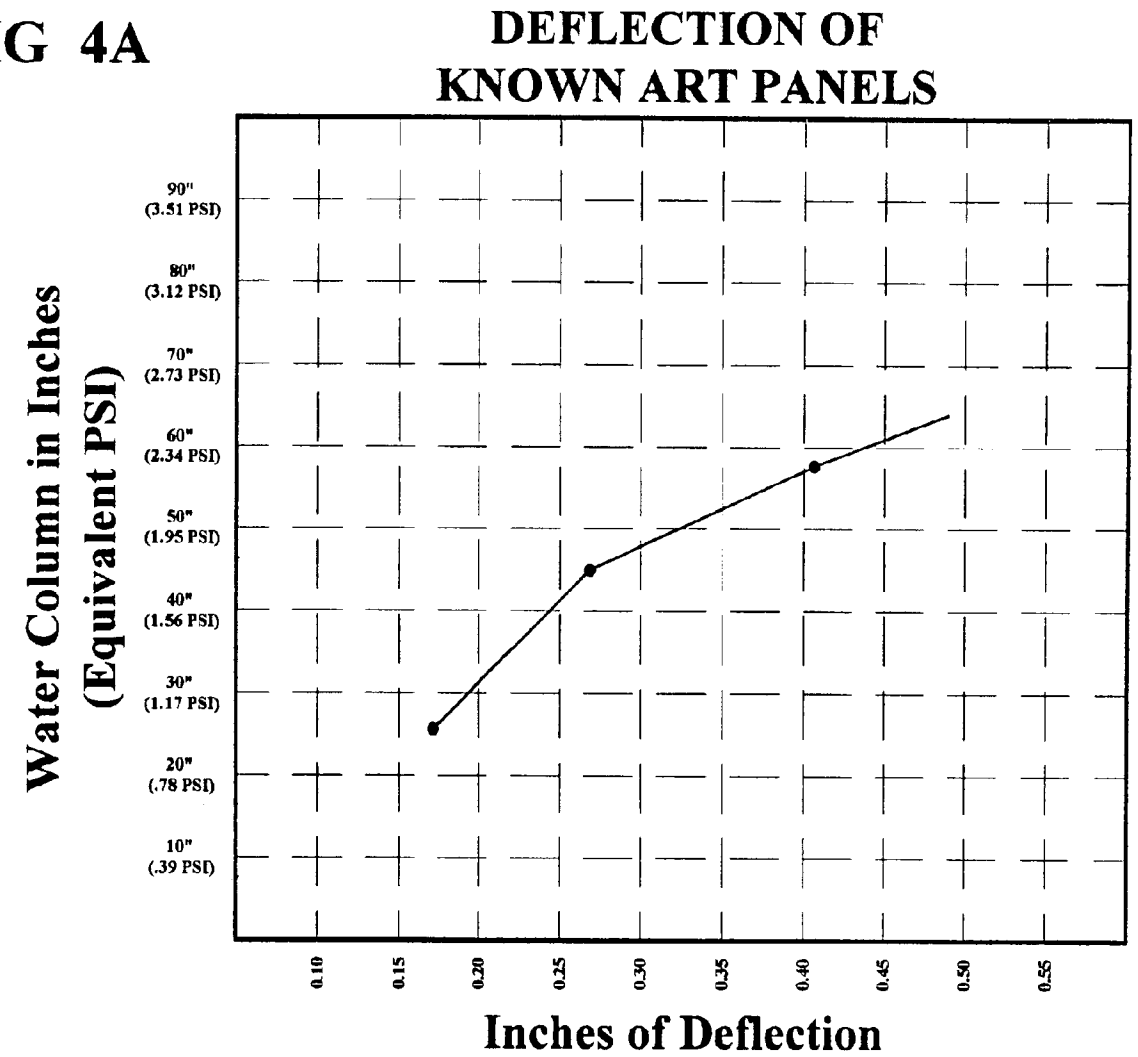
FIG. 4A is a graph showing the deflection of known art panels in inches at various water column heights, with equivalent pounds per square inch pressure shown in parentheses (PSI).
Figure 4B:
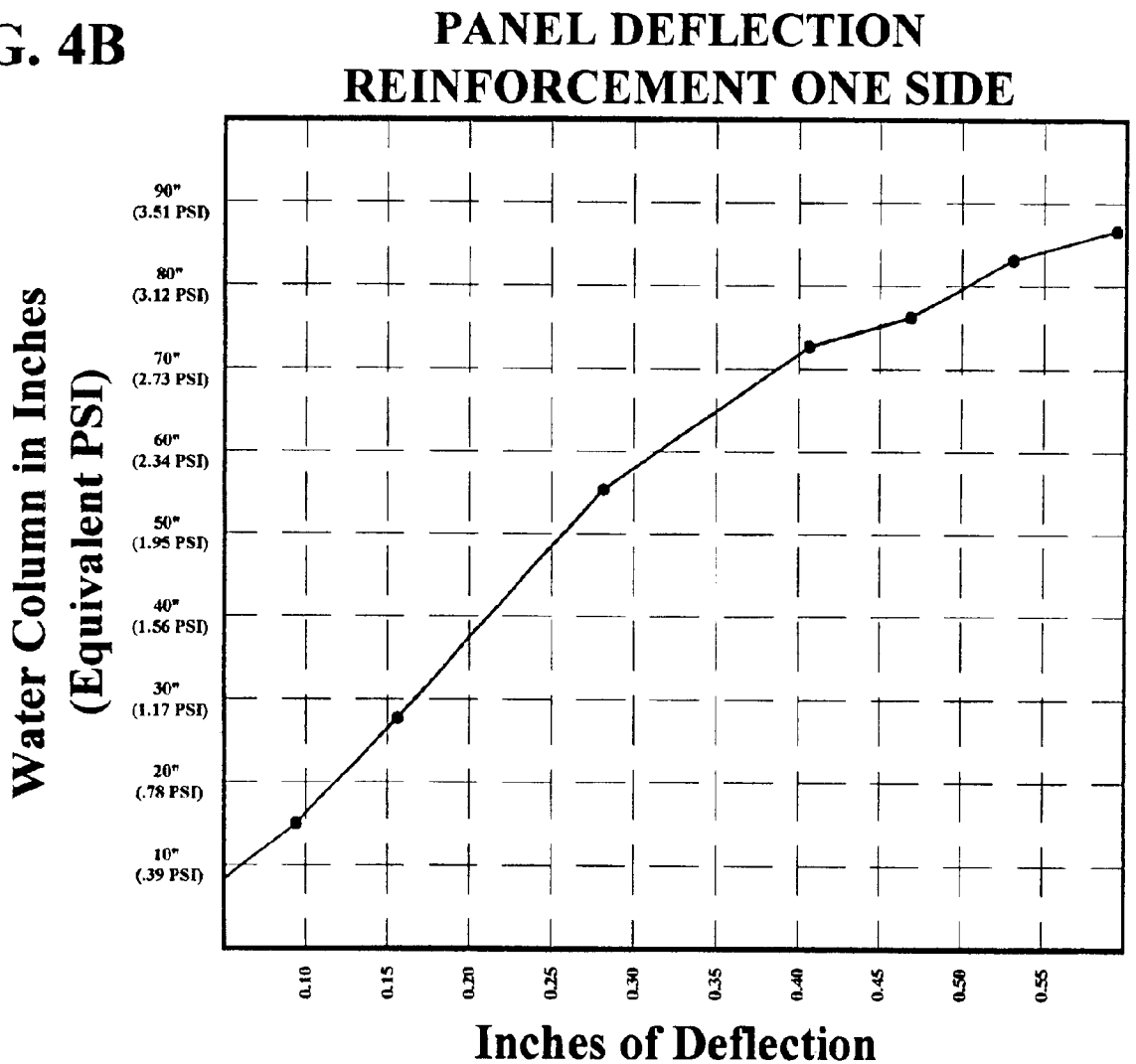
FIG. 4B is a graph showing the deflection of the panels disclosed in the present invention with a reinforcement layer on one side of the panels.
Figure 4C:
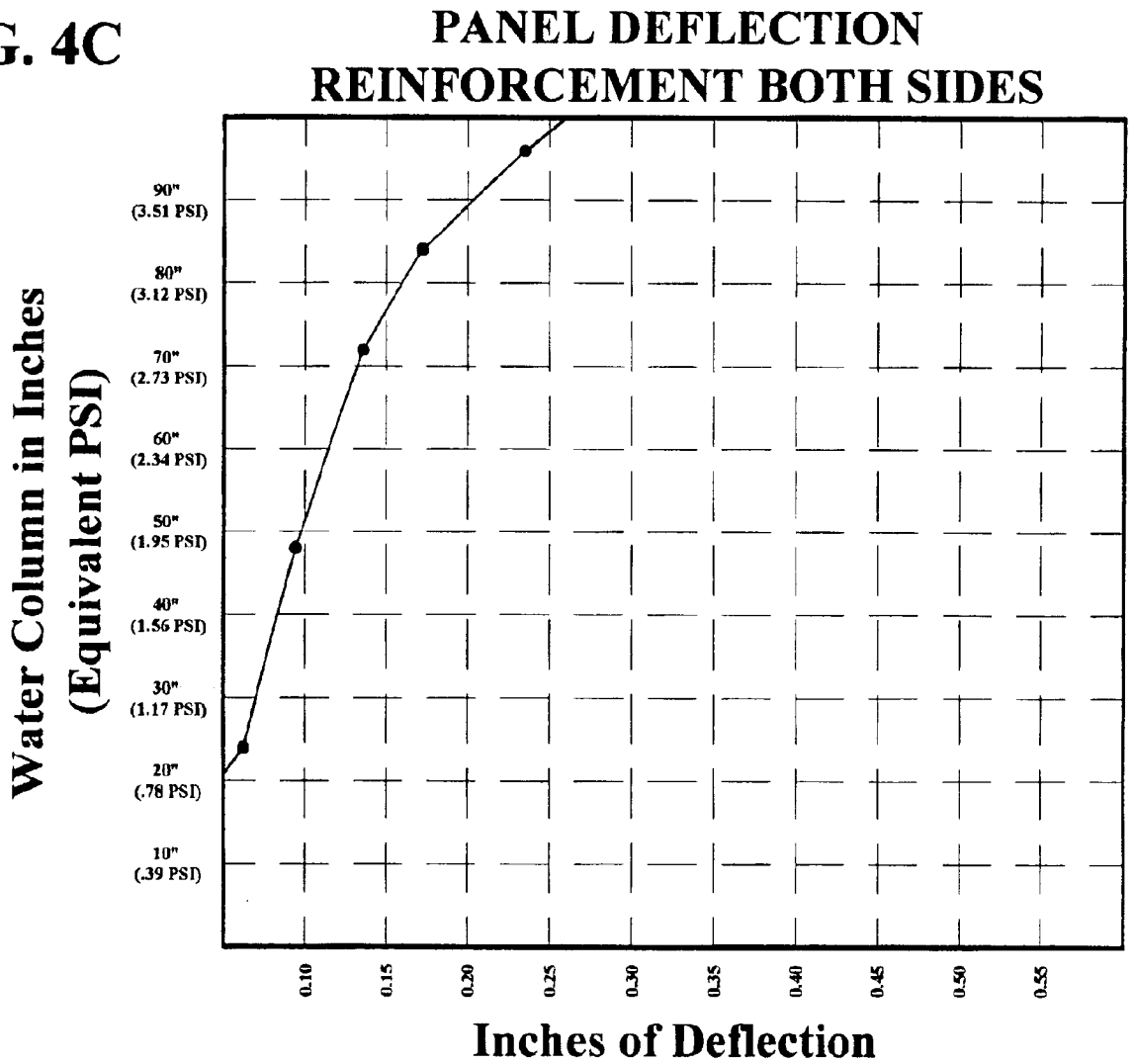
FIG. 4C is a graph showing the deflection of the panels disclosed in the present invention with reinforcement layers on both sides of the panels.

In the preferred embodiment the adhesive property of the polyurethane foam is used to adhere the outside 19 and inside 21 reinforcement layers to the foam plastic core 14, once bonded together these components act together as a composite unit. These composite form panels have amazing strength compared to known art systems. FIG. 4A shows typical deflections of known art panels in a testing chamber utilizing water to simulate concrete pressure, the known art panels failed at approximately 64" of water column. FIG. 4B shows deflection of panels of the present invention having a reinforcement layer on only one side of the foam plastic core, the panel did not fail in the tests. FIG. 4C shows deflection of panels of the present invention having reinforcement layers on both sides of the foam plastic core. The acceptable deflections shown in FIG. 4C were achieved using reinforcement layers having a 1200 P.S.I. tensile strength, deflection can be diminished using reinforcement layers with greater tensile strength. The studs 40, and horizontal stiffeners 25 are permanently embedded in the panels 11 during the molding process, creating a strong integral unit, as a result the embedded studs 40, and horizontal stiffeners 25 strengthen and reinforce the foam plastic. The combination of the outside reinforcement layer 19, inside reinforcement layer 21, studs 40, horizontal stiffeners 25 and foam plastic adds great strength to the forms 10. It is shown that the panels 11 of the present invention have much greater strength than the prior art, the foam plastic material is stronger and when it adheres to the panel components the form units 10 have even greater strength during material handling, construction and concrete placement.

Having reference to FIGS. 2*a*–2*b* and FIGS. 3*a*–3*b* the spreaders 30 and studs 40 are preferably extruded from plastic such as Acrylonitrile Butadiene Styrene (ABS), High Impact Polystyrene (HIPS), High Density Polyethylene (HDPE) or Polypropylene (PP), and are then punched or routed to obtain the finish parts.

The studs 40 (FIG. 3*a*) comprise a flange 41 for fastening finish materials and a groove 42 for sliding spreaders 30 into, with a web member 43 extending there between to interconnect the flange 41 and the groove 42. There are at least two studs 40 in each panel 11 that extend vertically the full height of the panels 11, providing a means of interconnecting opposing panels 11 and providing continuous means of attaching finish materials. The spacing of the studs 40 will vary from 8 inches to 16 inches depending on the thickness of the concrete core. The web member 43 comprises a vertical member which is oriented transversely to the flange 41 and the groove 42, in a second embodiment of the stud 40 (FIG. 3*b*) the web 43 has a plurality of apertures 44 along its length to enhance the bond with the panels 11.

Figure 2A:
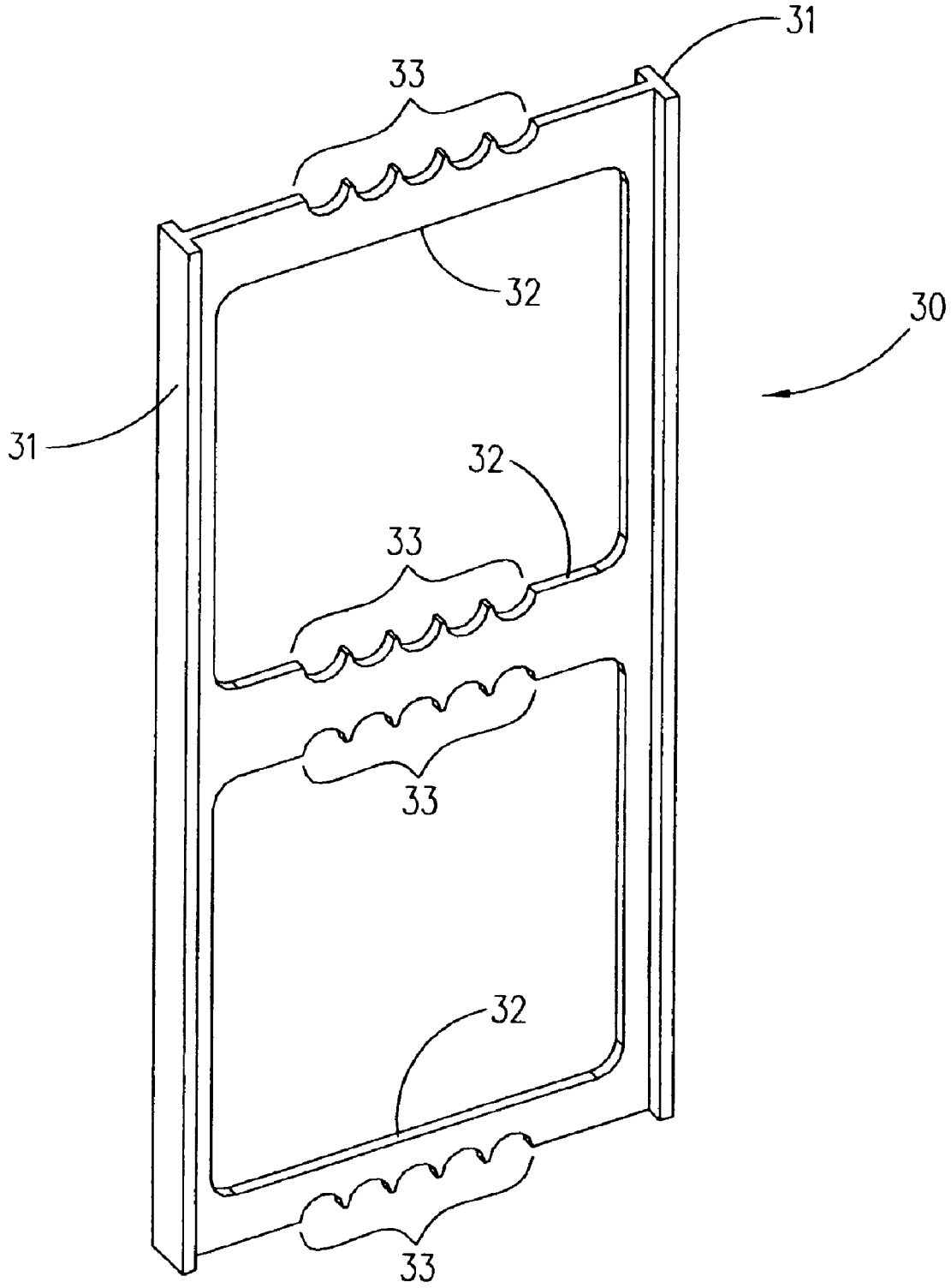
FIG. 2A is a perspective view of a spreader according to the present invention.
Figure 2B:
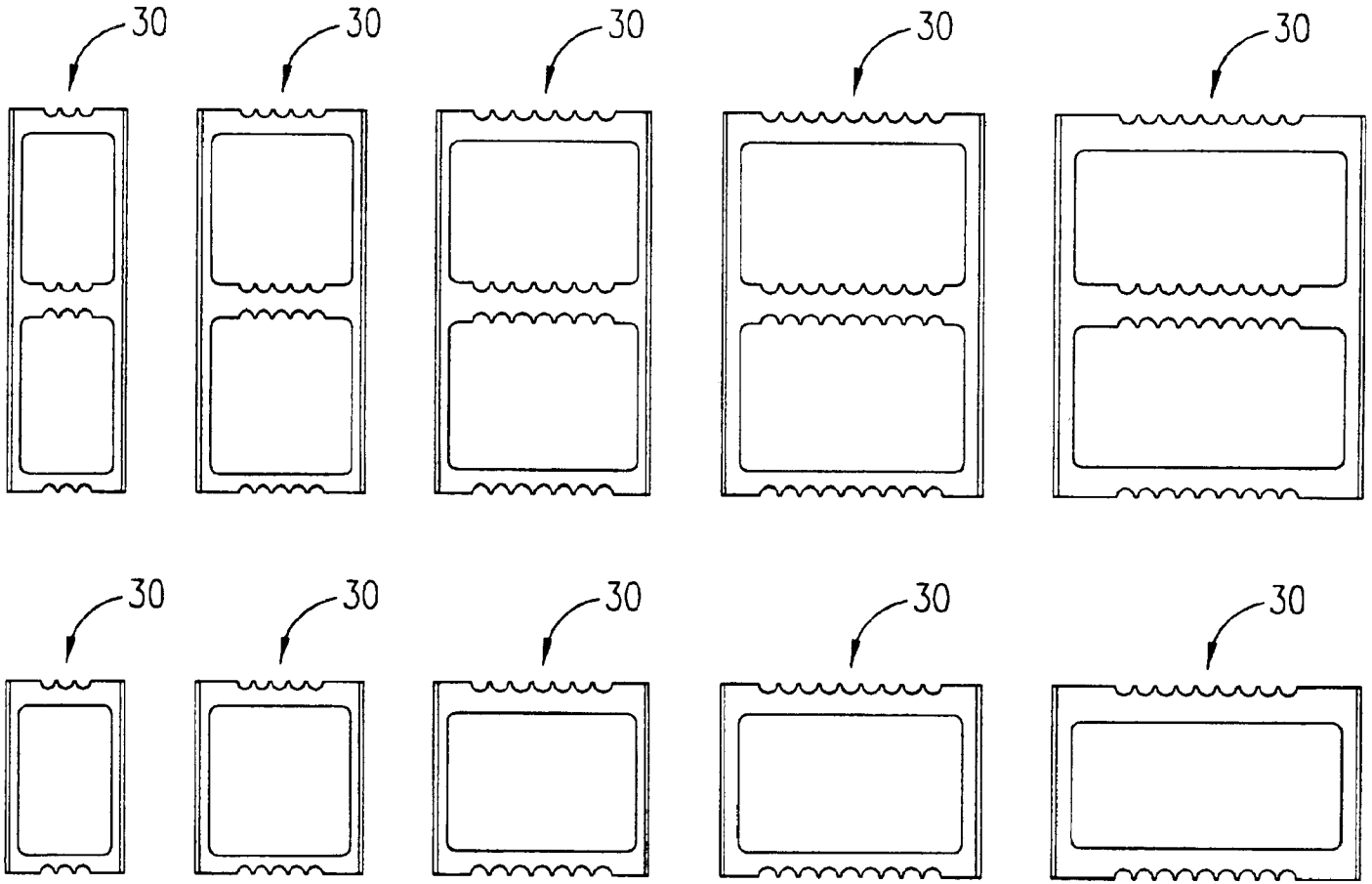
FIG. 2B is a side view showing different sizes of the spreader of FIG. 2A.
Figure 3A:
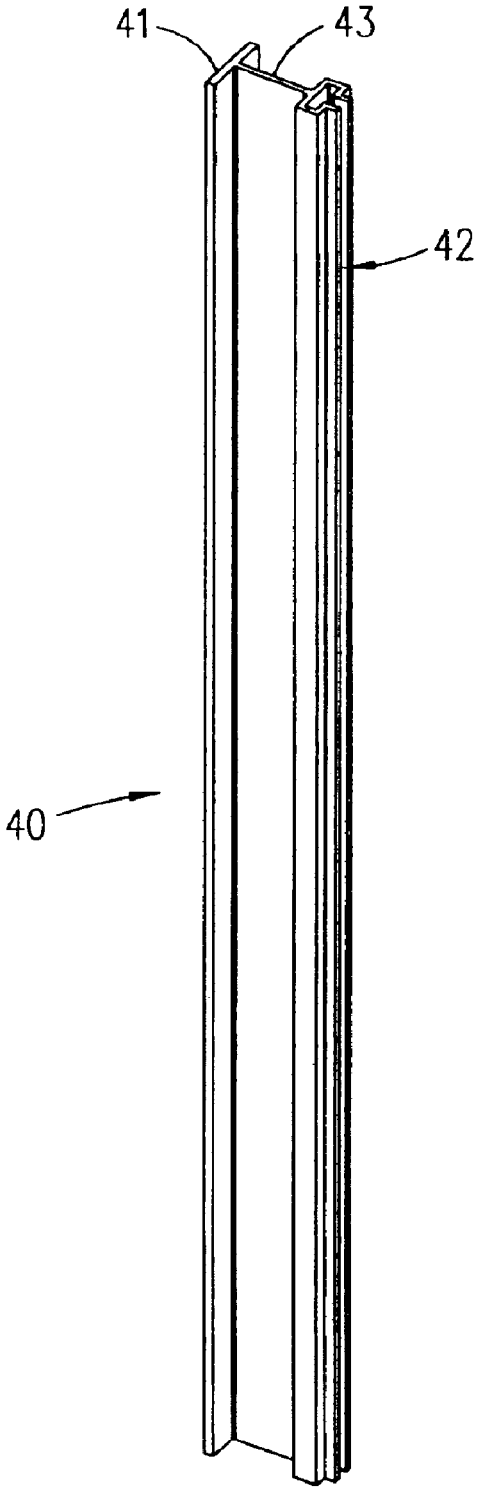
FIG. 3A is a perspective view of a stud according to the present invention.
Figure 3B:
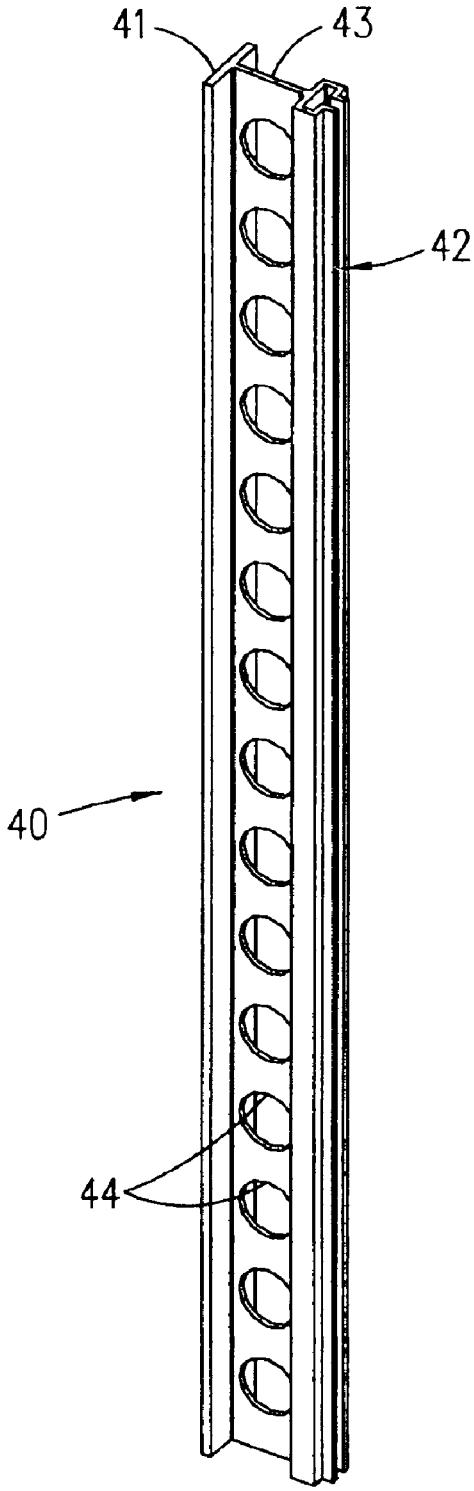
FIG. 3B is a perspective view of an embodiment of the invention showing a stud with apertures along its length.

The spreaders 30 as shown in FIG. 2*a*, comprise opposing flanges 31 connected by horizontal members 32, the flanges 31 slide into the grooves 42 of the studs 40. Each horizontal member 32 has multiple formations 33 to accommodate wall reinforcement bars. Preferably there are "full height spreaders" and "half height spreaders" as disclosed in a further embodiment which will be discussed later. The number of horizontal members 32 will vary depending on the thickness of the concrete core, typically the full height spreaders will have three horizontal members 32 and the half height spreaders will have two horizontal members 32. The topmost horizontal member is located substantially at the top of the flanges 31 and the bottommost horizontal member is located substantially at the bottom of the flanges 31. The formations 33 in the horizontal members 32 of both spreader configurations will occur in the top of the topmost member and in the bottom of the bottommost member. When the spreaders are stacked the bottom horizontal member of the spreader above will rest on the top member of the spreader below, the complimentary formations 33 forming a full circle allowing wall reinforcement bars to be restrained within the formations. The intermediate horizontal members will preferably have formations 33 on both sides of the member allowing the spreaders 30 to be reversible. Intermediate wall reinforcement bars if required will rest in the formations 33 of the intermediate horizontal members. The open design of the spreaders 30 allows the concrete to flow naturally through the wall, making concrete placement easier and resulting in a much stronger wall than the prior art. The spreaders 30 vary in width (FIG. 2*b*) to facilitate the casting of different concrete wall thicknesses, the walls are typically cast with concrete cores from 4 inches to 12 inches thick, the spreader 30 size increases in 1 inch increments to facilitate these different wall thicknesses. The slide-in spreader 30 configuration allows the panels to be shipped in compact units which reduces shipping costs. The slide-in spreaders 30 are quickly and easily installed saving time and money erecting the structures.

The horizontal stiffeners 25 preferably are made of similar plastic to the studs 40 and spreaders 30 or Poly Vinyl Chloride (PVC), and have a hollow cross-section. The horizontal stiffeners 25 are located at the midpoint of the panels 11 vertically and 1¼ inches from the outside face 12 and extend the length of the panels 11 horizontally. The stiffeners 25 can be utilized as a chase way for electrical wiring.

Figure 5A:
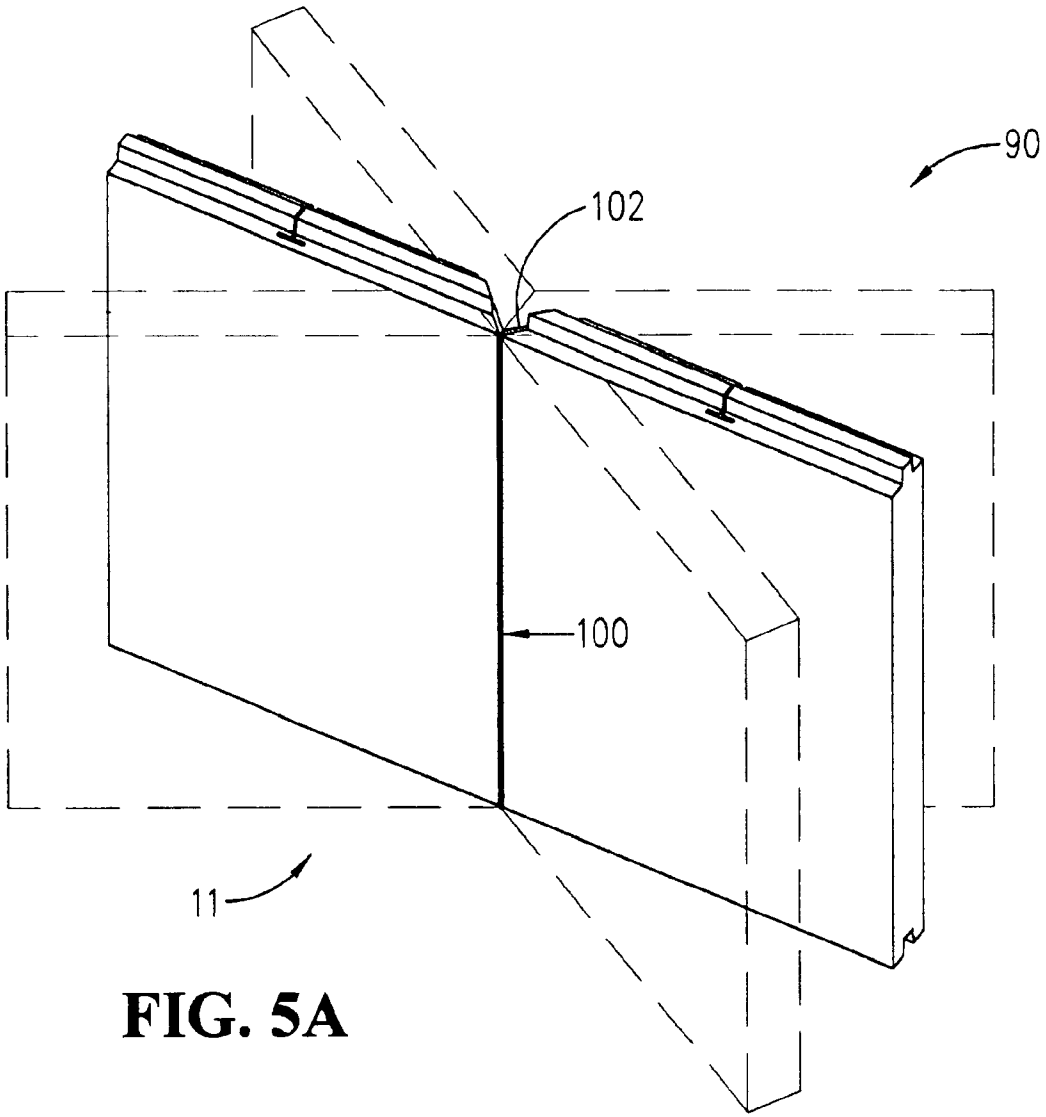
FIG. 5A is a perspective view of a hinged panel according to the present invention.
Figure 5B:
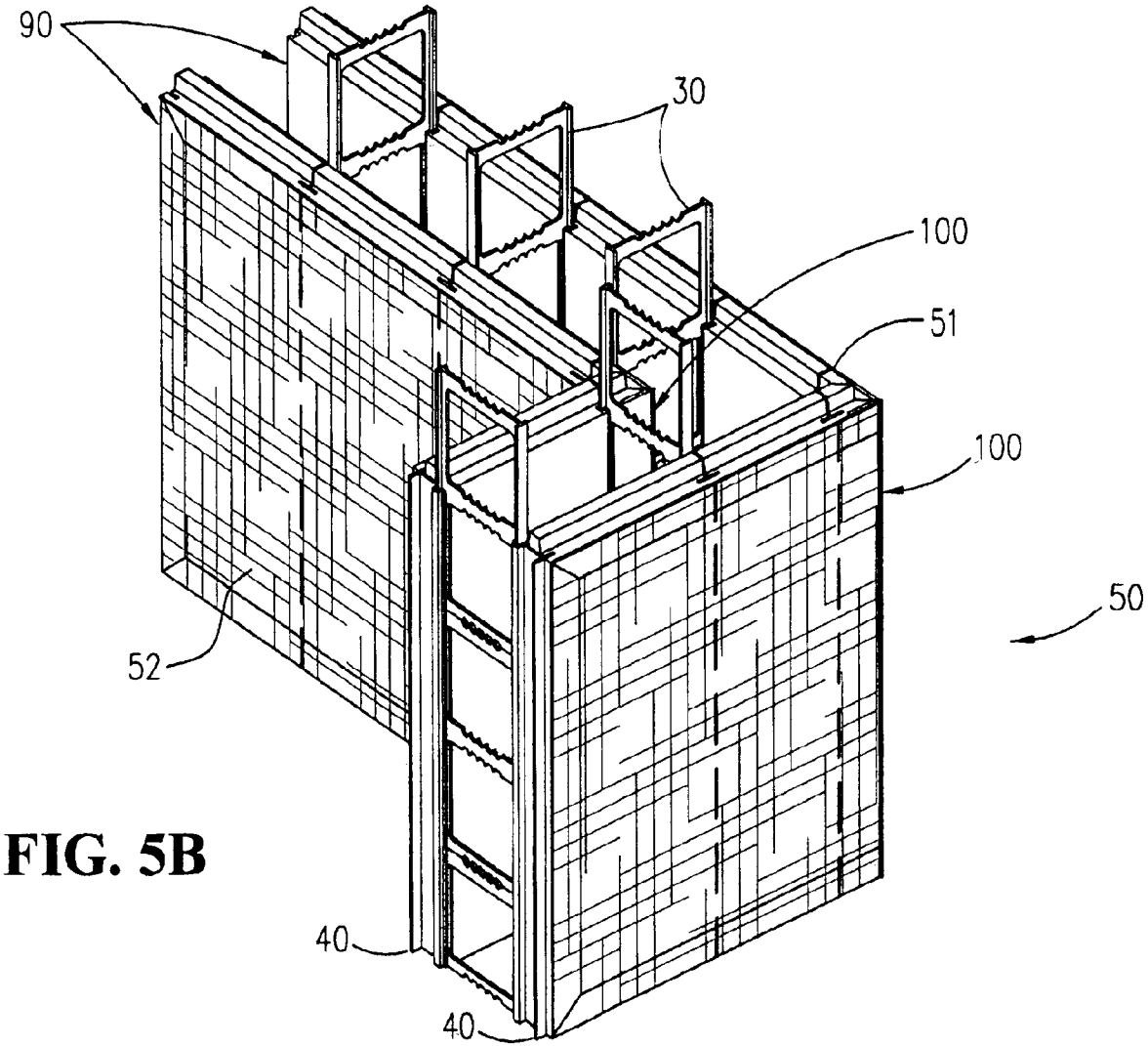
FIG. 5B is a perspective view of a hinged corner form according to the present invention, utilizing hinged panels of FIG. 5A with vertical pivotal points.
Figure 5C:
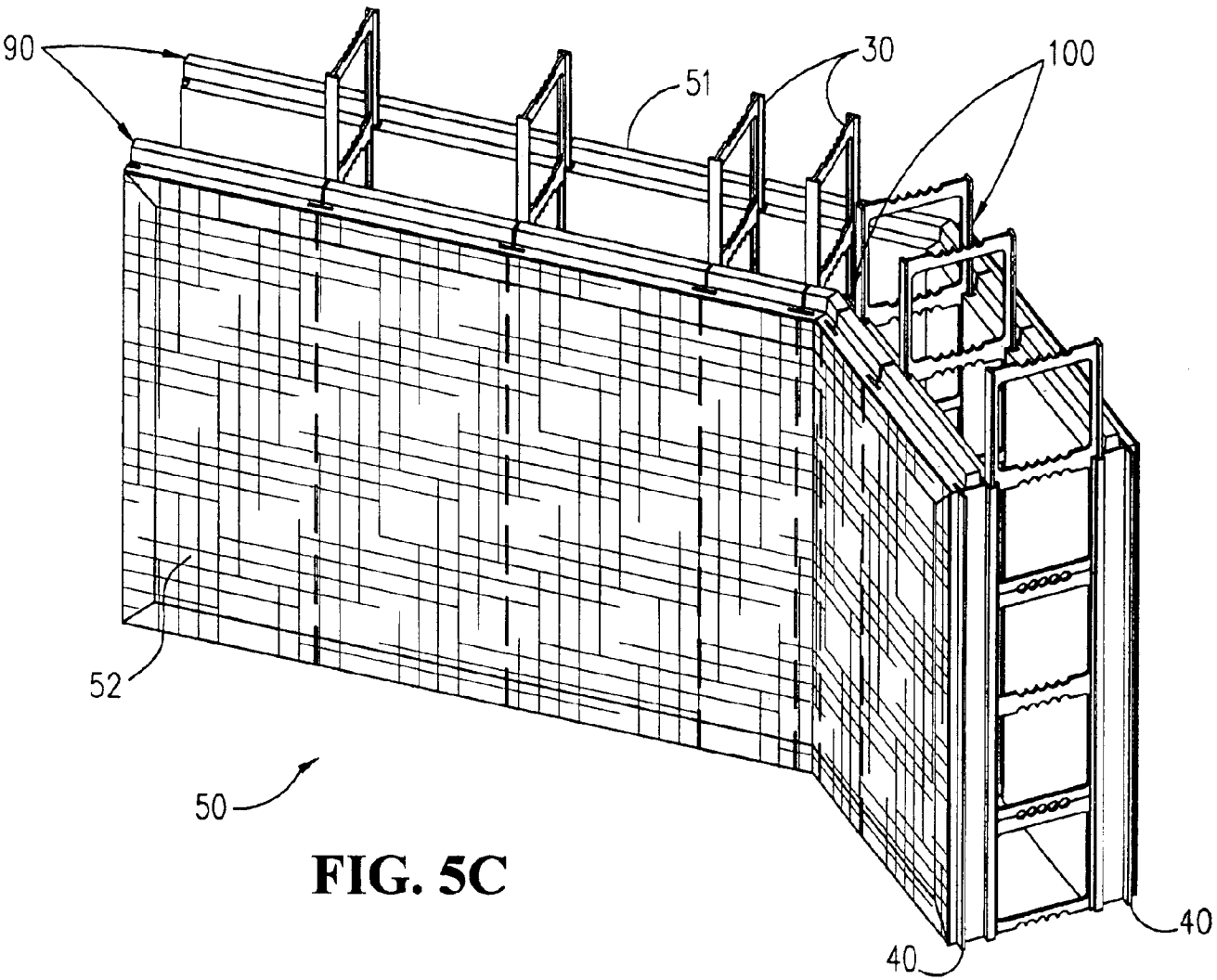
FIG. 5C is a perspective view of a hinged corner form according to the present invention oriented at an oblique angle, utilizing hinged panels of FIG. 5A with vertical pivotal points.
Figure 6A:
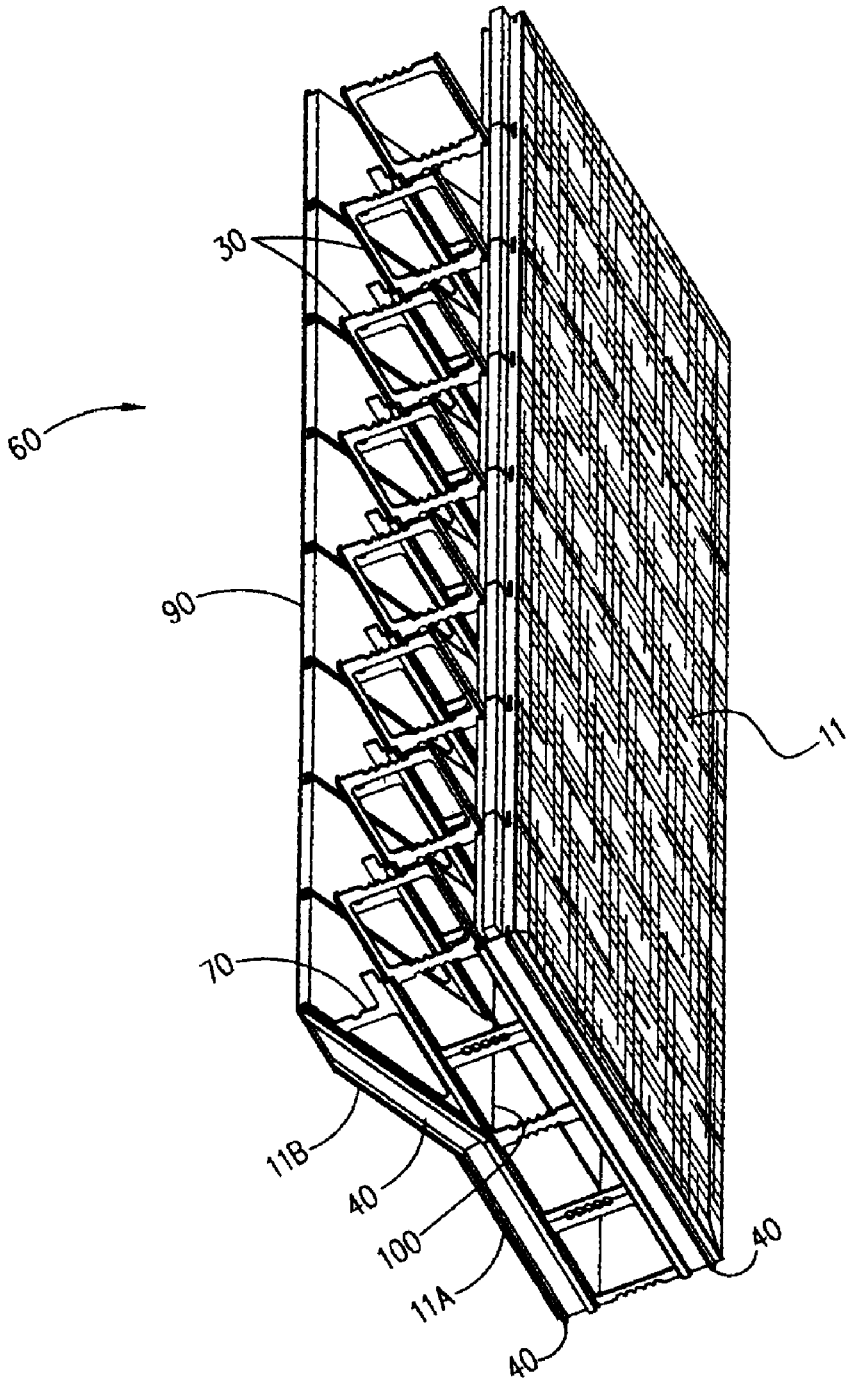
FIG. 6A is a perspective view of a bearing ledge form according to the present invention, utilizing a hinged panel of FIG. 5A with a horizontal pivotal point.
Figure 6B:
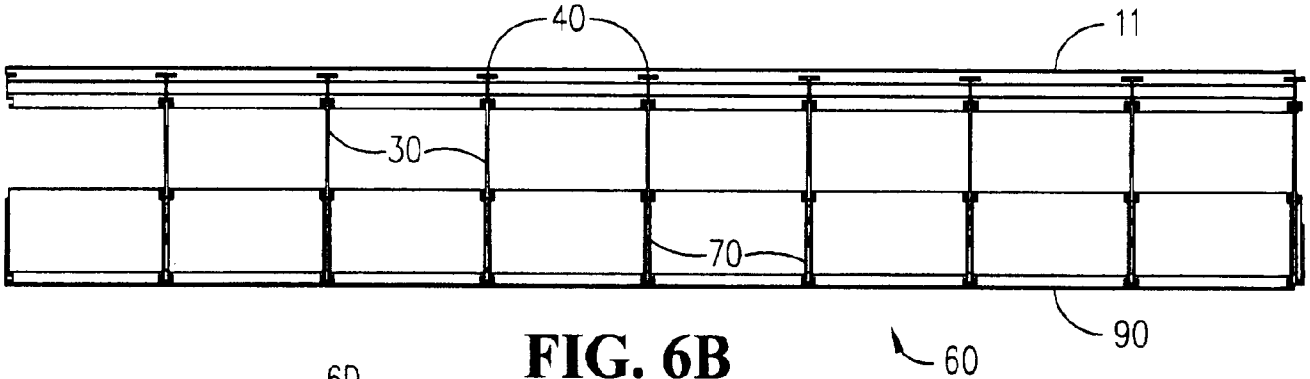
FIG. 6B is a top view of the bearing ledge form of FIG. 6A.
Figure 6C:
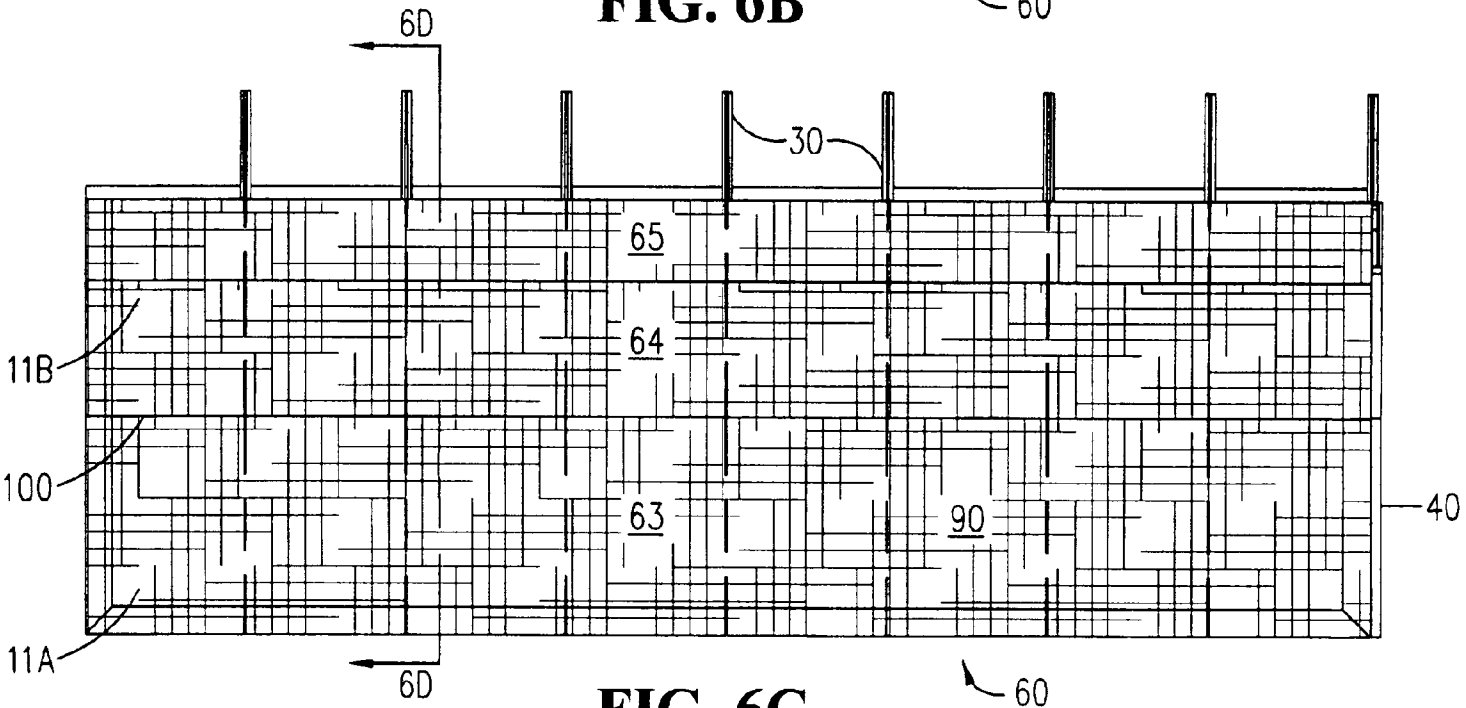
FIG. 6C is a side view of the bearing ledge form of FIG. 6A.
Figure 6D:
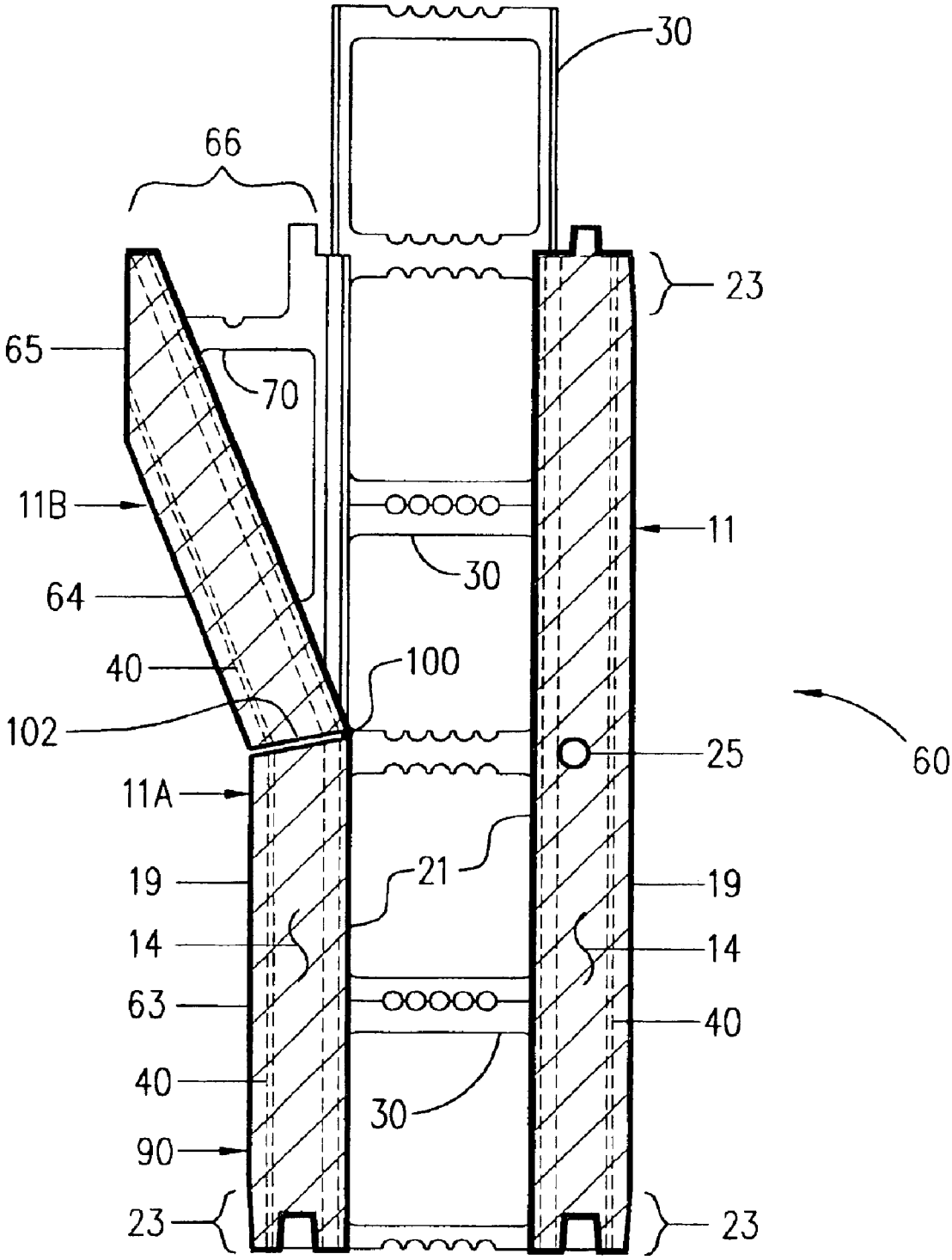
FIG. 6D is a cross-section view of the bearing ledge form of FIG. 6A, taken along line 6D—6D as shown in FIG. 6C.
Figure 7:
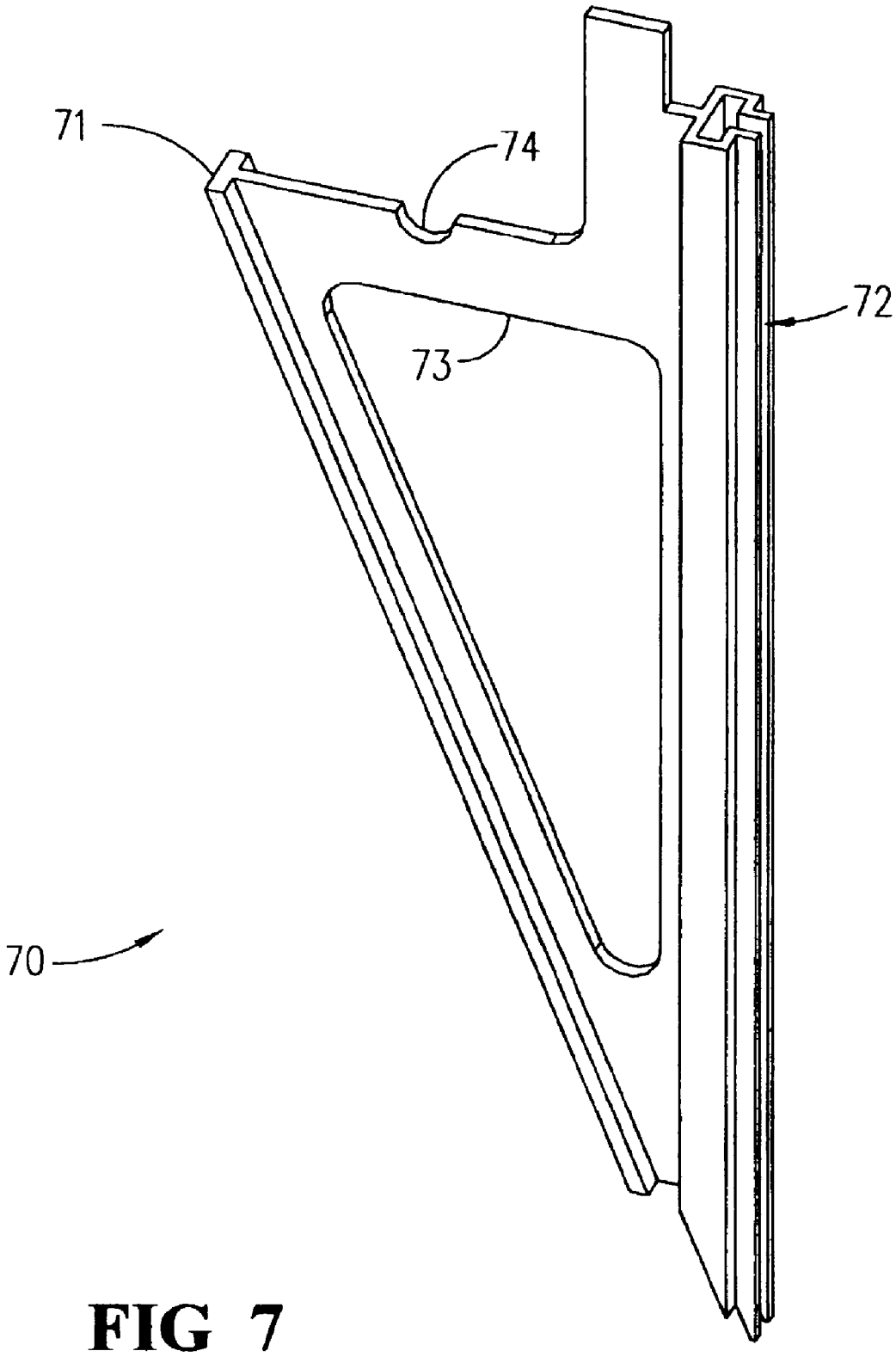
FIG. 7 is a perspective view of a bearing ledge form connector according to the present invention.

Another embodiment of the present invention, FIG. 5A–5C shows hinged form panels 90, comprising panels 11, having at least one vertical or horizontal pivotal point 100 extending substantially across the panel. The pivotal point 100 creates discontinuous panel sections, being connected together by a flexible pivotal member 102, the discontinuous panel sections are rotationally independent from each other. Preferably the pivotal member 102 is a flexible mesh that is adhered within the panels when they are molded, the panels being molded with discontinuity at each pivotal member 102. The hinged panels 90 can be bent to form corners, angles or tee walls, multiple pivotal points 100 can be installed in the panels 11 to form curved walls. The hinged panels 90 can be shipped flat to save space and then rotated into position on site. FIGS. 5B and 5C show hinged form panels 90 placed in an opposing spaced-apart relationship having a vertical pivotal section 100 in each of the opposing panels being used as corner forms 50. The outer panel defines the outside 51 of a corner 50, the inner panel defines the inside 52 of a corner 50. FIG. 5C shows a corner 50 formed at an oblique angle. Hinged forms 90 allow building corners to be erected quickly with little bracing.

Another embodiment of the present invention, FIGS. 6*a*–6*d* discloses a bearing ledge form 60 for the support of brick, rock and other veneers comprising a hinged form panel 90 and a conventional form panel 11 placed in an opposing and spaced-apart relationship. The hinged form panel 90 having a horizontal pivotal point 100 and two discontinuous panel sections 11A and 11B. The first discontinuous panel section 11A defining a plane 63, the second discontinuous panel section 11B having a first plane 64 and a second plane 65 at an angle to one another. The second discontinuous panel section 11B is rotated such that the first plane 64 of said panel section extends at an angle to the plane 63 of the first discontinuous panel section 11A and the second plane 65 of the second discontinuous panel section 11B is parallel to offset from the plane 63 of the first discontinuous panel section 11A forming a haunch 66. The hinged form panel 90 has embedded studs 40 in the first 11A and second 11B discontinuous panel sections that extend to the pivotal point 100, the studs are spaced longitudinally and parallel from each other. Specialized bearing ledge connectors 70 (FIG. 7) slidably engage the studs 40 located in the second discontinuous panel section 11B. The bearing ledge connectors 70 comprise a flange 71 for engaging the studs and a groove 72 for receiving spreaders, the flange 71 and groove 72 connect at a point, the flange 71 extending outwardly at an angle from the groove 72. The outermost extent of the flange 71 and groove 72 are connected by a web member 73, the web member 73 has formations 74 for wall reinforcement bars. The conventional form panel 11 has embedded studs 40 that extend substantially the full height of the form panels 11, the studs are spaced longitudinally and parallel from each other. A plurality of spreaders 30 at each stud 40 location extend between opposing panels and engage the studs 40 and bearing ledge connectors 70 in opposing panels creating a form with a cavity between the inside surfaces of the panels.

Figure 8:
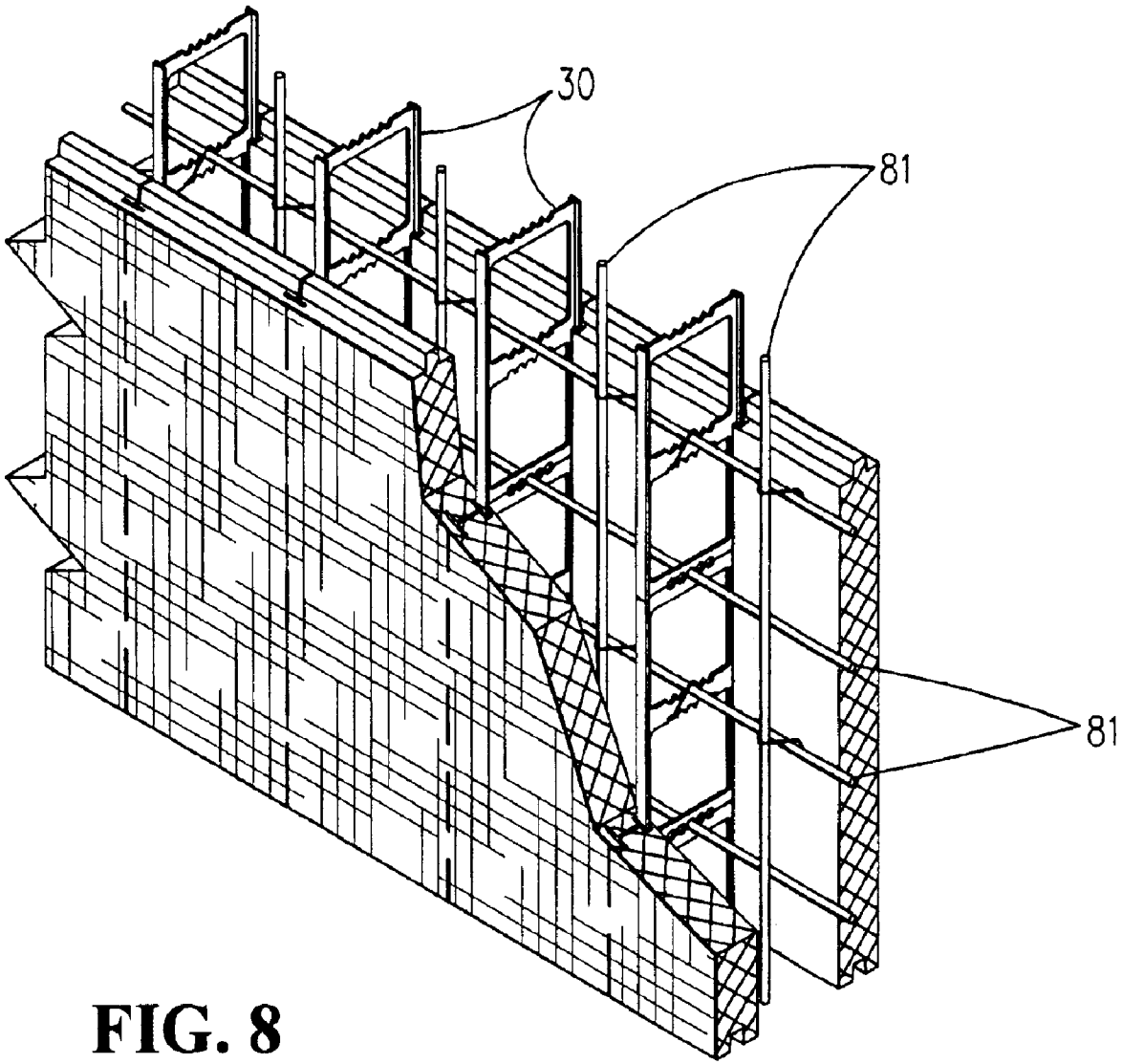
FIG. 8 is a perspective view of elements of the present invention illustrating interaction with wall reinforcement bars.
Figure 9:
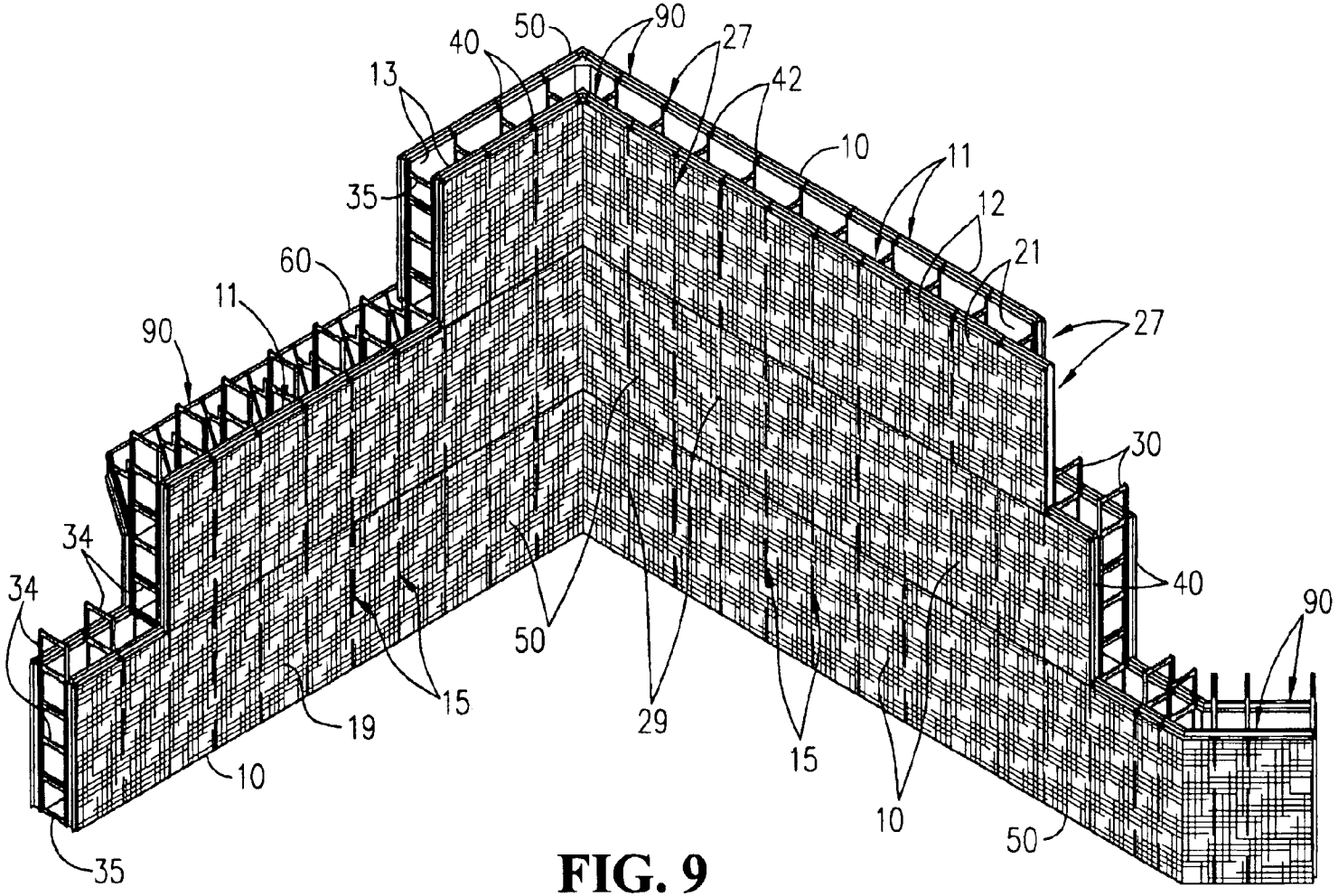
FIG. 9 is a perspective view of elements of the present invention interacting to form a reinforced composite system for the construction of insulated concrete structures.

Multiple form panels 11 are stacked together to form walls (FIG. 9), the panels 11 are placed in an opposing parallel spaced apart relationship with spreaders 30 that extend between the panels 11 and slide into the studs 40 thereby forming a cavity between the inside surface 13 of the panels 11, the cavity is then filled with fluid concrete. The panels 11 are placed end to end in rows and stacked vertically, the opposing panels 11 may be offset from each other so that the panel ends 24 do not line up from one side of the wall to the other 27, the rows of panels 11 are staggered back and forth so the end joints 29 of adjacent panels do not line up vertically. As the panels 11 are stacked, spreaders 30 are installed, which slide into and engage the grooves 42 of the studs 40 embedded in the opposing panels 11. The spreaders 30 are "full height spreaders" 34, which are half the height of the panels and "half height spreaders" 35, which are half the height of the full height spreaders 34. A half height spreader 35 is installed at the bottom of the wall with full height spreaders 34 thereafter, so at the top of each row of panels the spreaders 30 engage the studs 40 in the row of panels 11 below half their height and engage the studs 40 in the row of panels 11 above the remaining half of their height. Thus the present invention discloses a novel spreader 30 which overlaps the horizontal joints between rows of forms 10, connecting the rows and forcing the wall to act as one unit from bottom to top and also preventing the joints from shifting and bulging or causing blowouts, therefore very little bracing is required to straighten the walls and stabilize them during concrete placement. The formations 33 in the top and bottom horizontal members 32 of the spreaders 30 compliment the formations 33 in the spreaders 30 above and below allowing horizontal wall reinforcement bars to be locked in place. There are multiple formations 33 in each horizontal member 32 so the reinforcement bars can be installed at any location that might be required by professional engineers. FIG. 8 shows wall reinforcement bars 81 locked in the complimentary formations 33 of the spreaders 30. The ability of the spreaders 30 to lock reinforcement bars 81 in place eliminates most manual tying of the wall reinforcement. The full height studs 40 embedded in each form panel 11 allow them to be cut to any height and still provide a structurally sound unit, also door, window and other openings can be cut at any location without compromising the integrity of the wall.

There are many advantages over the prior art disclosed in the present invention:

The closed cell foam plastic is easily molded and has superior strength and adhesion, allowing the form panels to be cast in unlimited large sizes, and allows the reinforcement layers to be adhered to the panels and the studs embedded and bonded within the panels creating stronger form units.

The reinforcement layers add substantial strength to the panels during material handling, construction and concrete placement, provides a substrate for finish materials, provides a UV resistant surface on the panels and is marked for visually locating embedded studs and horizontal stiffeners.

Full height studs provide an additional means for attaching finish materials and engaging spreaders and add substantial strength to the forms.

The open configuration of the slide-in spreaders allows the concrete to flow naturally through the wall during placement, resulting in easier placement of the concrete and a much stronger wall.

Slide-in spreaders allow compact shipment of the forms and provide a means of quickly and easily erected the forms at the job site.

Formations in the spreader allow wall reinforcement bars to be locked in any preferred location.

The ability of the spreaders to overlap the horizontal joints between rows of panels interconnects the rows strengthening the wall and forcing it to act as one unit from bottom to top.

Embedded horizontal stiffeners strengthen the panels and provide a means of easily installing electrical wiring.

Hinged forms may be shipped flat saving shipping cost and allow corners of unlimited angles and tee walls to be formed quickly and easily with little bracing.

Bearing ledge forms provide support for brick, rock and other veneers and are useful for many other applications.

The stronger, larger form sizes and the configuration of the spreaders allow structure to be erected quickly with little bracing and allow the concrete to be placed easily with no danger of bulging or blowouts.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A reinforced composite system for constructing insulated concrete structures comprising:

panels having inside and outside surfaces, top, bottom and end edges, said panels placed horizontally in an opposing and parallel, spaced-apart relationship, panels having an interlocking means at the top and bottom edge of each panel; said panels comprising, a foam plastic core between outside and inside reinforcement layers, wherein said reinforcement layers extend substantially over, and are adhered to, the entire outside and inside surfaces of said foam plastic core, thus defining the surfaces of said panels, said reinforcement layers being substantially less in thickness than said foam plastic core and having greater tensile strength than foam plastic core, wherein outside reinforcement layer, foam plastic core and inside reinforcement layer are continuously adhered together over their entire area thus acting together as a composite panel to resist deflection;

said panels having tapered edges, the outside face of each panel being tapered starting from each edge of the panel extending away from the panel edges toward the middle of each panel;

at least two vertical studs embedded in each panel extending the full height of the panels, said studs spaced longitudinally and parallel from each other, said studs adhered within foam plastic core, the exterior of the panels being marked at each stud location allowing studs to be located visually; said studs comprising, a flange for receiving mechanical fasteners and a groove for receiving spreaders, with a web member extending there between to interconnect the flange and groove, said webs comprising, a vertical member extending between and oriented transversely to the flange and the groove;

at least one horizontal stiffener embedded in each panel between inside and outside surfaces of foam core and parallel to inside and outside surfaces of foam core, said horizontal stiffeners located equal distances from top and bottom edges of panels, said horizontal stiffeners adhered within foam plastic core;

said interlocking means comprising, a tongue extending from and parallel to the top edge of each panel, and a complementary groove recessed into and parallel to the bottom edge of each panel said tongue and groove comprising complimentary preformed units adhered to the foam plastic core, the groove unit of each panel having appendages protruding into the grove, the spacing of the appendages corresponding with the locations of embedded studs, and the tongue unit of each panel having slots that compliment said appendages, such that when said panels are stacked the appendages in the grooves engage the slots in the tongues forcing studs from adjacent panels into a vertical alignment;

a plurality of spreaders at each stud location, extending between opposing panels and slidably engaging the studs in opposing panels, thereby creating a form with a cavity between the inside surfaces of the panels for receiving fluid concrete; said spreaders comprising, a first flange and second flange for engaging studs, flanges oriented in an opposing parallel relationship, flanges being connected by horizontal members, each horizontal member having multiple formations to support and restrain wall reinforcement bars, wherein formations in the topmost horizontal members are located in the top of said members, top most horizontal member being located substantially at the top of the flanges, and wherein formations in the bottommost horizontal members are located in the bottom of said members, bottommost horizontal member being located substantially at the bottom of the flanges, thus when spreaders are stacked the formations in the top and bottom horizontal members compliment the formations of adjacent spreaders, the horizontal member from the upper spreader resting upon the horizontal member of the spreader below, the complimentary formations each forming half of a full circle, allowing wall reinforcement bars to be restrained within the circular formations, intermediate horizontal members having formations on both sides of the member allowing spreaders to be reversible.

2. A reinforced composite system for constructing insulated concrete structures as claimed in claim 1 wherein the horizontal stiffener comprises a hollow tubular member adhered within the foam plastic core, located equal distances from top and bottom edges of panels and extending substantially between the end edges of the panels.

3. A reinforced composite system for constructing insulated concrete structures as claimed in claim 2 wherein the hollow horizontal stiffener is utilized to install electrical wiring.

4. A reinforced composite system for constructing insulated concrete structures as claimed in claim 1 wherein the inside reinforcement layer extends around the tongue extending from and parallel to the top edge of each panel and into the groove recessed into and parallel to the bottom edge of each panel, thus defining and reinforcing the tongue and groove.

5. In a reinforced composite system for constructing insulated concrete structures, a hinged form comprising:

panels having inside and outside surfaces, top, bottom and end edges, said panels placed horizontally in an opposing and parallel, spaced-apart relationship, panels having an interlocking means at the top and bottom edge of each panel;

at least one opposing panel having at least one vertical or horizontal pivotal section extending substantially across the panel, the panel being discontinuous at the pivotal location;

a flexible pivotal member interconnecting the discontinuous panel such that each side of the discontinuous panel is rotationally independent from the remainder of the panel, said pivotal section comprising an elongated flexible member adhered to the panel;

at least one vertical stud embedded in each panel on each side of pivotal section extending substantially the full height of the panels, said studs spaced longitudinally and parallel from each other;

a plurality of spreaders at each stud location, extending between opposing panels and engaging the studs in opposing panels thereby creating a form with a cavity between the inside surfaces of the panels.

6. A reinforced composite system for constructing insulated concrete structures, as claimed in claim 5 comprising:

opposing panels each having at least one vertical pivotal section, each panel being rotatably movable between a flat position and rotated position, wherein the outer panel defines the outside of a corner and the inside panel defines the inside of a corner.

7. A reinforced composite system for constructing insulated concrete structures, as claimed in claim 5 comprising:

opposing panels, first panel opposing panel having at least one horizontal pivotal section defining first and second discontinuous panel sections, said discontinuous panel sections being rotatably movable between a flat position and rotated position, wherein the first discontinuous panel section defines a plane, the second discontinuous panel section having a first and second plane at an angle to one another, the second discontinuous panel section being rotated at an angle to the first discontinuous panel section such that the first plane of the second discontinuous panel section extends at an angle to the plane of the first discontinuous panel section, the second plane of the second discontinuous panel section being parallel to and offset from the plane of the first discontinuous panel section, defining a haunch usable as a bearing ledge;

at least two vertical studs embedded in first discontinuous panel section extending to the pivotal section, said studs spaced longitudinally and parallel from each other;

at least two vertical studs embedded in second discontinuous panel section, said studs spaced longitudinally and parallel from each other;

bearing ledge connectors at each stud location in second discontinuous panel section, slidably engaging the studs, said bearing ledge connectors comprising a flange for engaging the studs and a groove for receiving spreaders, flange and groove connecting at a point, the flange extending outwardly at an angle from the groove, the outermost extent of the flange and groove being connected by at least one web member, web member having formations to accept wall reinforcement bars;

at least two vertical studs embedded in second opposing panel extending the full height of the panel, said studs spaced longitudinally and parallel from each other;

a plurality of spreaders at each stud location, extending between opposing panels and engaging the studs and bearing ledge connectors in opposing panels, thereby creating a form with a cavity between the inside surfaces of the panels.

8. A reinforced composite system for constructing insulated concrete structures comprising:

form panels having inside and outside surfaces, top, bottom and end edges, panels having an interlocking means at the top and bottom edge of each panel, said panels comprising, a foam plastic core between outside and inside reinforcement layers, wherein said reinforcement layers extend substantially over, and are adhered to, the entire outside and inside surfaces of said foam plastic core, thus defining the surfaces of said panels, said reinforcement layers being substantially less in thickness than said foam plastic core and having greater tensile strength than foam plastic core, wherein outside reinforcement layer, foam plastic core and inside reinforcement layer are continuously adhered together over their entire area thus acting together as a composite panel to resist deflection;

at least two vertical studs embedded in each panel extending substantially the full height of the panels;

at least one horizontal stiffener embedded in each panel between inside and outside surfaces of foam core and parallel to inside and outside surfaces of foam core;

multiple opposing form panels being placed end to end in horizontal rows and stacked vertically, panels being staggered from each other in such a manner that ends of opposing panels are offset and end joints between adjacent rows of stacked panels do not line up vertically;

said interlocking means comprising, a tongue extending from and parallel to the top edge of each panel, and a complementary groove recessed into and parallel to the bottom edge of each panel, wherein the inside reinforcement layer of each panel extends around the tongue and into the groove of said panel thus defining and reinforcing the tongue and groove, the groove of each panel having appendages protruding into the groove, the spacing of the appendages corresponding with the locations of embedded studs and the tongue of each panel having slots that compliment said appendages, such that when panels are stacked the appendages in the grooves engage the slots in the tongues forcing studs from adjacent panels into a vertical alignment;

the end interface of panels comprising, a stud halfway into, and protruding halfway from, the end edge of a first panel, and a complimentary slot in the end edge of a second panel, such that when the panels are placed end to end the panels interlock and spreaders may be installed to connect the opposing pairs of panels;

a plurality of spreaders at each stud location, extending between opposing panels and slidably engaging the studs in opposing panels, thereby creating a form with a cavity between the inside surfaces of the panels for receiving fluid concrete, the spreaders being "full height spreaders," half the vertical height of panels, and "half height spreaders," half the height of the full height spreaders, spreaders being stacked vertically, starting with a half height spreader with full height spreaders thereafter, such that at the top of each row of panels there is a full height spreader that engages the studs in the row below half its height and engages the studs in the row above the remaining half of its height, said spreaders comprising, a first flange and second flange for engaging studs, flanges oriented in an opposing parallel relationship, flanges being connected by horizontal members, each horizontal member having multiple formations to support and restrain wall reinforcement bars, wherein formations in the topmost horizontal members are located in the top of said members, top most horizontal member being located substantially at the top of the flanges, and wherein formations in the bottommost horizontal members are located in the bottom of said members, bottommost horizontal member being located substantially at the bottom of the flanges, thus, when spreaders are stacked the formations in the top and bottom horizontal members compliment the formations of adjacent spreaders the horizontal member from the upper spreader resting upon the horizontal member of the spreader below, the complimentary formations each forming half of a full circle, allowing wall reinforcement bars to be restrained within the circular formations.

9. A reinforced composite system for constructing insulated concrete structures as claimed in claim 8 comprising:

tapered panel edges, the outside face of each panel being tapered starting from each edge of the panel extending away from the panel edges toward the middle of each panel, such that when opposing panels are stacked vertically the horizontal and vertical joints between panels are indented inwardly from the face of the panels, allowing the joints to be pre-treated when covering the walls with an exterior finish such as stucco.

* * * * *